US010850381B2

(12) United States Patent
Ikuta et al.

(10) Patent No.: US 10,850,381 B2
(45) Date of Patent: Dec. 1, 2020

(54) IMPACT TOOL

(71) Applicant: MAKITA CORPORATION, Anjo (JP)

(72) Inventors: Hiroki Ikuta, Anjo (JP); Hikaru Sunabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 114 days.

(21) Appl. No.: 16/097,696

(22) PCT Filed: May 10, 2017

(86) PCT No.: PCT/JP2017/017767
§ 371 (c)(1),
(2) Date: Oct. 30, 2018

(87) PCT Pub. No.: WO2017/199823
PCT Pub. Date: Nov. 23, 2017

(65) Prior Publication Data

US 2019/0152039 A1 May 23, 2019

(30) Foreign Application Priority Data

May 18, 2016 (JP) ..... 2016-099754

(51) Int. Cl.
*B25D 17/11* (2006.01)
*B25D 11/06* (2006.01)
(Continued)

(52) U.S. Cl.
CPC ..... *B25D 17/11* (2013.01); *B25D 11/06* (2013.01); *B25D 17/24* (2013.01); *B25D 16/00* (2013.01);
(Continued)

(58) Field of Classification Search
CPC ..... B25D 17/24; B25D 11/125; B25D 11/06; B25D 16/00; B25D 16/006; B25D 16/003;
(Continued)

(56) References Cited

U.S. PATENT DOCUMENTS 3,783,970 A * 1/1974 Danielson ..... B25D 17/02 181/207
4,602,689 A 7/1986 Wanner
(Continued)

FOREIGN PATENT DOCUMENTS

JP S51-42573 U 3/1976
JP 2005-349480 A 12/2005
JP 2010-142916 A 7/2010

OTHER PUBLICATIONS

Jul. 2, 2019, Office Action issued in Japanese Patent Application No. 2018-518243.
(Continued)

*Primary Examiner* — Dariush Seif
(74) *Attorney, Agent, or Firm* — Oliff PLC

(57) ABSTRACT

An impact tool includes a tool-accessory holding part, a body and a first hammering member. The tool-accessory holding part has a through hole extending in a hammering-axis direction and is configured to hold the tool accessory inserted into the through hole to be movable in the hammering-axis direction. The body is connected to the tool-accessory holding part in the hammering-axis direction and has an internal space communicating with the through hole. The first hammering member is linearly movable in the hammering-axis direction and configured to drive the tool accessory in the hammering-axis direction by colliding with the tool accessory. The tool-accessory holding part and the body are connected in the hammering-axis direction via a first elastic element to be movable relative to each other. A
(Continued)

second elastic element is interposed between the first hammering member and the body in a radial direction with respect to the hammering axis.

11 Claims, 12 Drawing Sheets

(51) Int. Cl.
*B25D 17/24* (2006.01)
*B25D 16/00* (2006.01)

(52) U.S. Cl.
CPC ..... *B25D 2217/0076* (2013.01); *B25D 2250/085* (2013.01)

(58) Field of Classification Search
CPC ..... B25D 2211/068; B25D 2216/0084; B25D 2217/0076; B25D 2250/121; B25D 2250/265; B25D 2250/391; B25D 2250/085
USPC ... 173/162.2, 162.1, 201, 210, 104, 109, 48, 173/110
See application file for complete search history.

(56) References Cited

U.S. PATENT DOCUMENTS 5,971,403 A * 10/1999 Yahagi ..... B23Q 3/12 279/19.3
6,561,285 B2 * 5/2003 Intonen ..... B25D 17/00 173/210
7,124,840 B2 * 10/2006 Miyakawa ..... B25D 17/24 173/162.1
7,624,815 B2 * 12/2009 Friedrich ..... B03C 1/286 173/126
7,726,413 B2 * 6/2010 Berghauser ..... B25D 17/082 173/171
7,819,203 B2 * 10/2010 Sato ..... B25D 17/11 173/128
8,037,947 B2 * 10/2011 Miwa ..... B25D 17/06 173/210
8,181,716 B2 * 5/2012 Robson ..... B25D 17/08 173/210
8,459,658 B2 * 6/2013 Cycon ..... B25D 17/02 173/128
8,695,723 B2 * 4/2014 Werner ..... B25D 17/06 173/162.1
8,708,061 B2 * 4/2014 Nickels ..... B25D 17/24 173/211
9,278,443 B2 * 3/2016 Robson ..... B25D 17/24
9,937,612 B2 * 4/2018 Bito ..... B25D 11/04
2003/0221847 A1 * 12/2003 Funfer ..... B25D 17/06 173/201
2004/0222001 A1 * 11/2004 Ikuta ..... B25D 11/125 173/210
2005/0016744 A1 * 1/2005 Miyakawa ..... E02F 3/966 173/124
2005/0269117 A1 * 12/2005 Sato ..... B25D 17/11 173/132
2009/0236110 A1 * 9/2009 Iwakami ..... B25D 17/06 173/122
2010/0155094 A1 * 6/2010 Ikuta ..... B25D 17/08 173/162.1
2011/0073339 A1 * 3/2011 Werner ..... B25D 17/06 173/162.2
2016/0067856 A1 * 3/2016 Bito ..... B25D 17/24 173/128
2017/0312902 A1 * 11/2017 Noguchi ..... B25F 5/006

OTHER PUBLICATIONS

Sep. 17, 2019 Office Action in Japanese Patent Application No. 2018-518243.
Aug. 8, 2017 International Search Report issued in International Patent Application No. PCT/JP2017/017767.
Nov. 20, 2018 International Preliminary Report on Patentability issued in International Patent Application No. PCT/JP2017/017767.

* cited by examiner

IMPACT TOOL

TECHNICAL FIELD

The present invention relates to an impact tool configured to linearly drive a tool accessory in a prescribed hammering-axis direction.

BACKGROUND ART

An impact tool is known which is configured to linearly drive a tool accessory in an axial direction by intermittently striking an end of the tool accessory to thereby perform a processing operation on a workpiece. In such an impact tool, noise may arise due to vibration, which is caused by striking the tool accessory. Therefore, for example, patent document 1 discloses a structure for reducing noise which is caused when the tool accessory swings in a radial direction by reaction force from the workpiece and collides with a tool holder.

PRIOR ART DOCUMENT

Patent Document

Patent Document 1: Japanese laid-open patent publication No. 2010-142916

SUMMARY OF THE INVENTION

Problems to be Solved by the Invention

The impact tool disclosed in patent document 1 realizes reduction of noise to some extent by suppressing the swing of the tool accessory in the radial direction. In order to improve an working environment, however, further noise reduction is desired.

It is an object of the present invention to provide a technology which helps reduce noise in an impact tool configured to linearly drive a tool accessory in a prescribed hammering-axis direction.

Embodiment to Solve the Problem

According to one aspect of the present invention, an impact tool is provided which is configured to linearly drive a tool accessory in a prescribed hammering-axis direction. The impact tool includes a tool-accessory holding part, a body and a first hammering member.

The tool-accessory holding part has a through hole extending in the hammering-axis direction, and is configured to hold the tool accessory inserted into the through hole so as to be movable in the hammering-axis direction. The body is connected to the tool-accessory holding part in the hammering-axis direction. The body has an internal space which communicates with the through hole. The first hammering member is disposed to be linearly movable in the hammering-axis direction and configured to drive the tool accessory in the hammering-axis direction by colliding with the tool accessory. The tool-accessory holding part and the body are connected in the hammering-axis direction via a first elastic element so as to be movable relative to each other. Further, a second elastic element is interposed between the first hammering member and the body in a radial direction with respect to the hammering axis.

In the impact tool in which the first hammering member is configured to drive the tool accessory by colliding with the tool accessory, vibration of the tool accessory which is caused by striking the tool accessory is transmitted to the tool-accessory holding part. If this vibration is further transmitted to the body having the internal space, noise is liable to increase. In order to cope with this, connecting the tool-accessory holding part and the body in the hammering-axis direction via the first elastic element so as to be movable relative to each other can suppress transmission of the vibration from the tool-accessory holding part to the body. Further, like the tool accessory, the first hammering member also generates vibration due to impact of collision. In order to cope with this, the second elastic member which is interposed between the first hammering member and the body in the radial direction can suppress transmission of the vibration from the first hammering member to the body in the radial direction. By thus suppressing the transmission of the vibration from the tool accessory and the first hammering member to the body, noise which might otherwise arise from the vibration of the body can be reduced.

It is noted, in a case where the body has an outer surface directly exposed to the outside, that is, a contact surface with outside air (especially in a case where the outer surface is relatively large), the outer surface is liable to increase the noise by vibrating the air. Further, in a case where the body is formed of metal, this tendency is more apparent. In terms of these points, examples of the body may include an outer exposed part having an outer surface directly exposed to the outside (a contact surface with outside air), and an outer exposed part formed of metal. A typical example of the outer exposed part may be a cylindrical part which houses the first hammering member configured to drive the tool accessory and a driving element (typically, a piston or a piston cylinder) configured to linearly move the first hammering member.

According to one aspect of the impact tool of the present invention, a portion of the tool-accessory holding part may be disposed between the first hammering member and the body in the radial direction. The second elastic element may be disposed between the portion of the tool-accessory holding part and the body. In a case where a portion of the tool-accessory holding part is disposed between the first hammering member and the body in the radial direction, vibration transmitted from the tool accessory to the tool-accessory holding part and vibration transmitted from the hammering member to the tool-accessory holding part may be transmitted to the body in the radial direction. To cope with this, the second elastic element which is disposed between the portion of the tool-accessory holding part and the body can effectively suppress the transmission of the vibration to the body and thereby reduce noise.

According to one aspect of the impact tool of the present invention, the first elastic element may be rubber. Further, the first elastic element may be interposed between the tool-accessory holding part and the body so as to be compressed when the tool-accessory holding part and the body relatively move in either direction toward or away from each other in the hammering-axis direction. Generally, rubber has higher bearing force in a compression direction than in a tensile direction. Therefore, by configuring the first elastic element formed of rubber such that the first elastic element is compressed when the tool-accessory holding part and the body relatively move in either direction toward or away from each other, durability of the first elastic element can be favorably maintained.

According to one aspect of the impact tool of the present invention, the impact tool may further include a first member and a second member. The first member may be fixed to the tool-accessory holding part and may be disposed between the tool-accessory holding part and the body in the hammering-axis direction. The second member may be fixed to the body and may be disposed between the tool-accessory holding part and the first member in the hammering-axis direction. Further, at least a portion of the first elastic element may be interposed between the first member and the second member. In this case, the first elastic element can be configured such that a pardon of the first elastic element which is interposed between the tool-accessory holding part and the body is compressed when the tool-accessory holding part and the body relatively move toward each other, while another portion of the first elastic element which is interposed between the first member and the second member is compressed when the tool-accessory holding part and the body relatively move away from each other.

According to one aspect of the impact tool of the present invention, the tool-accessory holding part may include a cylindrical slide-guide member which is configured to slidably guide the first hammering member in the hammering-axis direction. The first member may be integrally formed with the slide-guide member. Generally, the tool-accessory holding part includes a slide-guide member. Therefore, in a case where the slide-guide member and the first member are integrally formed as a single member, assembling efficiency can be improved and the number of components can be reduced, as compared with a case where the first member is formed as a separate member from the sliding guide member.

According to one aspect of the impact tool of the present invention, the impact tool may further include a plurality of first members and a plurality of second members. The plurality of first members may be fixed to the tool-accessory holding part and may be disposed between the tool-accessory holding part and the body in the hammering-axis direction. The plurality of second members may be fixed to the body and may be disposed between the tool-accessory holding part and the plurality of first members in the hammering axis-direction. The plurality of first members and the plurality of second members may be alternately arranged in a circumferential direction around the hammering axis. Further, at least a portion of the first elastic element may be interposed between the plurality of first members and the plurality of second members. In this case, the first elastic element can be configured such that a portion of the first elastic element which is interposed between the tool-accessory holding part and the body is compressed when the tool-accessory holding part and the body relatively move toward each other, while another portion of the first elastic element which is interposed between the first members and the second members is compressed when the tool-accessory holding part and the body relatively move away from each other. Furthermore, the tool-accessory holding part and the body can move relative to each other in a well-balanced manner along the hammering axis.

According to one aspect of the impact tool of the present invention, the impact tool may further include a circular cylindrical member and a second hammering member. The circular cylindrical member may be disposed coaxially with the hammering axis, in the internal space of the body. The second hammering member may be disposed to be movable in the hammering-axis direction within the circular cylindrical member and may be configured to linearly move the first hammering member by colliding with the first hammering member. Further, the second hammering member may have a circular column part having a circular column shape, and the second hammering member may have one or more third elastic elements disposed on an outer circumferential surface of the circular column part. The one or more third elastic elements may be slidable in the hammering-axis direction along an inner circumferential surface of the circular cylindrical member, and may be configured to hold the second hammering member within the circular cylindrical member in a state in which the outer circumferential surface of the second hammering member is not in contact with the inner circumferential surface of the circular cylindrical member. Vibration is also caused in the second hammering member when the second hammering member moves and collides with the first hammering member within the circular cylindrical member disposed in the internal space of the body. In order to cope with this, the one or more third elastic elements on the outer circumferential surface of the second hammering member which hold the second hammering member in a non-contact state with respect to the inner circumferential surface of the circular cylindrical member can suppress transmission of the vibration from the second hammering member to the circular cylindrical member and thus to the body and reduce noise.

According to one aspect of the impact tool of the present invention, the second hammering member may be configured to be moved in the hammering-axis direction within the circular cylindrical member by pressure fluctuations of air in an air chamber formed in the circular cylindrical member. At least one of the one or more third elastic elements may have an annular shape to surround a whole circumference of the outer circumferential surface of the second hammering member and may also serve as a sealing member for the air chamber. In this case, it is not necessary to additionally and separately provide a sealing member which is required to maintain airtightness of the air chamber in a structure using air pressure fluctuations of the air chamber to move the second hammering member.

According to one aspect of the impact tool of the present invention, the first elastic element and the second elastic element may be integrally formed as a single elastic member. In this case, compared with a case in which the first and second elastic elements are separately formed, assembling efficiency can be improved and the number of components can be reduced.

According to one aspect of the impact tool of the present invention, the first elastic element may be rubber and an outer circumferential surface of the first elastic element may be covered. Since the first elastic element connects the body and the tool-accessory holding part in the hammering-axis direction, the outer surface of the first elastic element in the hammering-axis direction is likely to be in contact with the body, the tool-accessory holding part or another member, while the outer circumferential surface (an outer surface on the radially outer side) of the first elastic element is likely to be exposed to the outside. According to the present aspect, however, deterioration of the first elastic element can be suppressed which might otherwise be caused by exposure to dust generated during the processing operation of the tool accessory. It is noted that the outer circumferential surface of the first elastic element may be covered by either one or both of the body and the tool-accessory holding part. Alternatively, the outer circumferential surface of the first elastic element may be covered by a member other than the body and the tool-accessory holding part.

DESCRIPTION OF EMBODIMENT

An embodiment of the present invention is now described with reference to the drawings. In the present embodiment, an electric hammer 1 (hereinafter simply referred to as a hammer 1) is described as an example of an impact tool which is configured to linearly drive a tool accessory in a prescribed hammering-axis direction.

Figure 1:
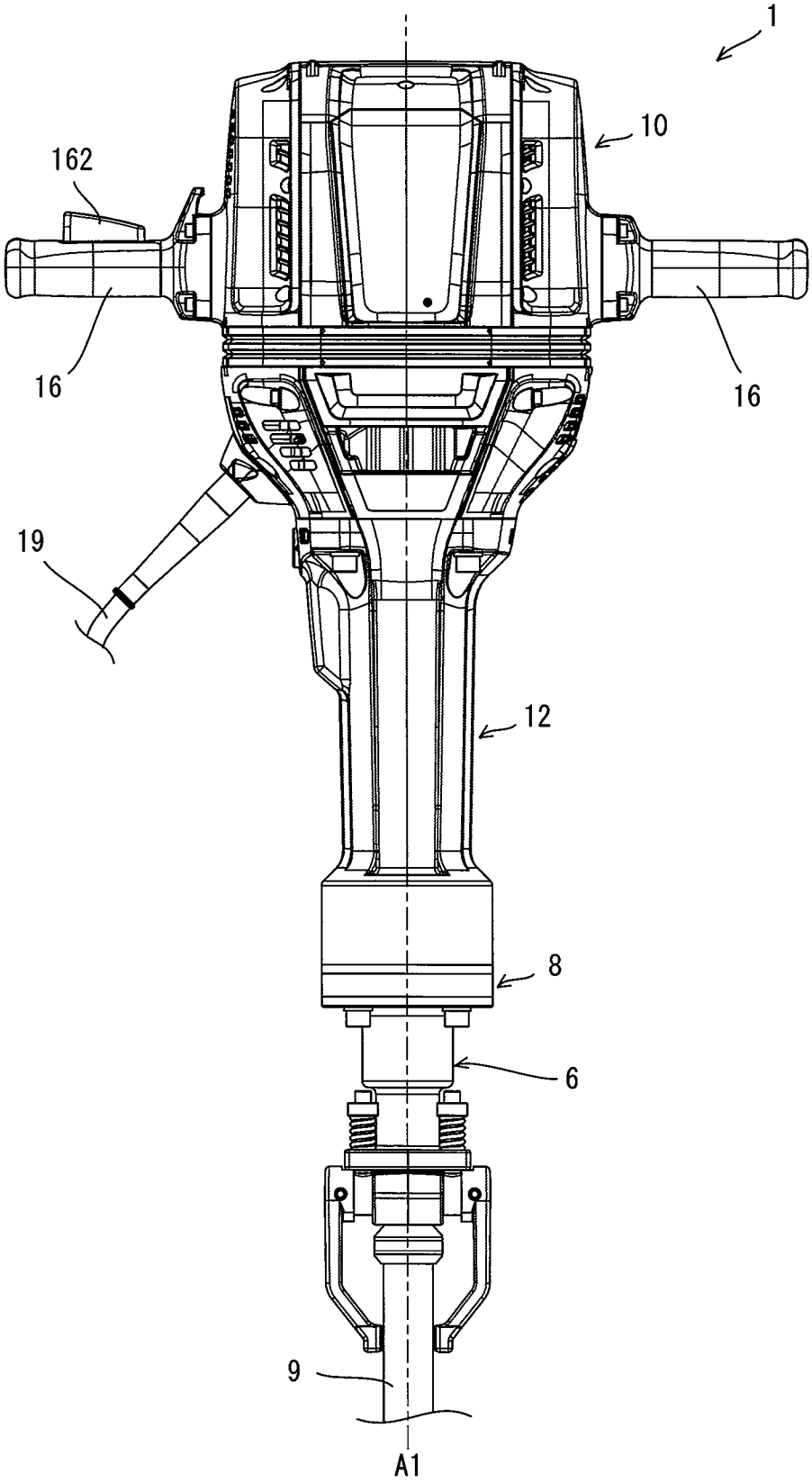
FIG. 1 is a front view showing an electric hammer with a tool accessory attached thereto.

First, the general structure of the hammer 1 is described with reference to FIG. 1. The hammer 1 includes a body 10 and a tool holder 6. The body 10 has an elongate shape extending in a direction of a prescribed hammering axis A1 (hammering-axis A1 direction). One end portion of the body 10 in the hammering-axis A1 direction forms a barrel 12. The barrel 12 is formed as a cylindrical part having an internal space. The tool holder 6 is connected to one end portion of the barrel 12 in the hammering-axis A1 directions.

The tool holder 6 is configured to detachably hold a tool accessory 9 (typically, a hammer bit). The hammer 1 of the present embodiment is configured to perform an operation (a hammering operation) of linearly driving the tool accessory 9 coupled to the tool holder 6 along the hammering axis A1. A user may select the tool accessory 9 of an appropriate kind according to a processing operation to be actually performed and attach the tool accessory 9 to the tool holder 6 such that an axial direction of the tool accessory 9 coincides with the hammering axis A1. The hammer 1 may perform a chipping operation on a workpiece by the hammering operation.

A pair of handles 16 are provided on the body 10 on the opposite side of the tool holder 6 with respect to the barrel 12 in the hammering-axis A1 direction. The handles 16 are symmetrically arranged with respect to the hammering axis A1 and protrude from the body 10 in a direction generally orthogonal to the hammering axis A1. The hammer 1 of the present embodiment is configured as a large hammer having a weight of about 30 kg. Generally, the user may use the hammer 1 while holding the handles 16 with both hands, with the tool accessory 9 coupled to the tool holder 6 protruding downward. Therefore, in the following description, for convenience of explanation, the hammering-axis A1 direction (also referred to as a longitudinal-axis direction of the body 10 or an axial direction of the tool accessory 9) is defined as an up-down direction of the hammer 1. In the hammering-axis A1 direction, the side of the tool holder 6 is defined as a lower side and the side of the handles 16 is defined as an upper side. Further, the extending direction of the handles 16 is defined as a left-right direction.

Figure 2:
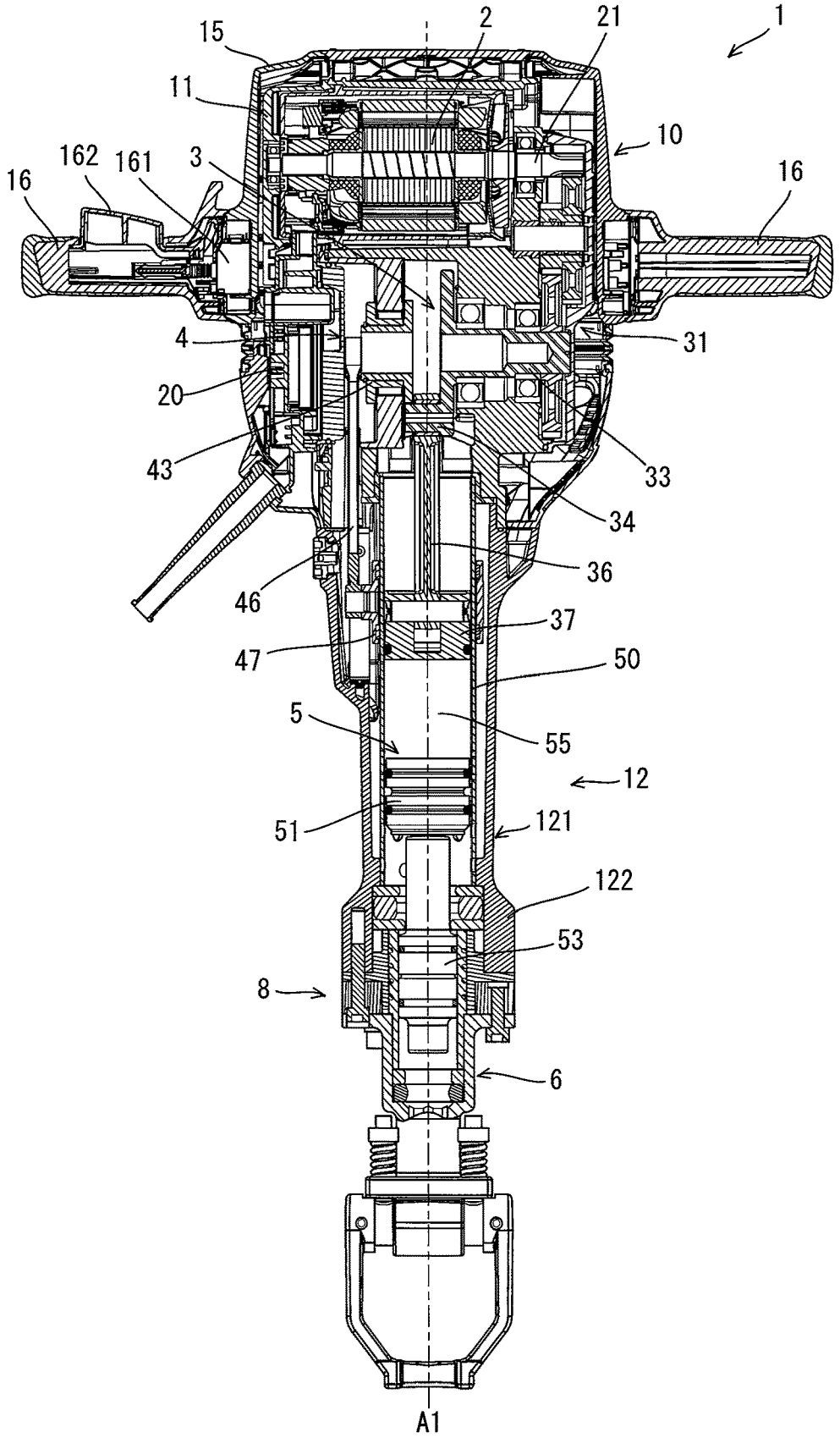
FIG. 2 is a longitudinal sectional view of the electric hammer.

The detailed structure of the hammer 1 is now described. First, the structure of the body 10 is described with reference to FIGS. 2 and 3. As shown in FIG. 2, the body 10 includes a body housing 11, an outer housing 15, the barrel 12, a cylinder 50, a motor 2, a first motion converting mechanism 3 and a second motion converting mechanism 4, of which structures are described below one by one.

As shown in FIG. 2, the body housing 11 is configured as a housing which houses the motor 2, the first motion converting mechanism 3 and the second motion converting mechanism 4.

The outer housing 15 is arranged outside the body housing 11 so as to cover the body housing 11. Each of the handles 16 is arranged in a cantilevered form, with one end of the handle 16 fixed to the outer housing 15. One of the handles 16 has an electric switch 161 and a trigger 162 for switching on and off the electric switch 161. Further, although not described in detail, an upper portion of the outer housing 15 including the handles 16 is connected to the body housing 11 via an elastic element so as to be movable in the hammering-axis A1 direction (up-down direction) relative to the body housing 11. Such a structure can suppress transmission of vibration from the body housing 11 to the handles 16.

Figure 3:
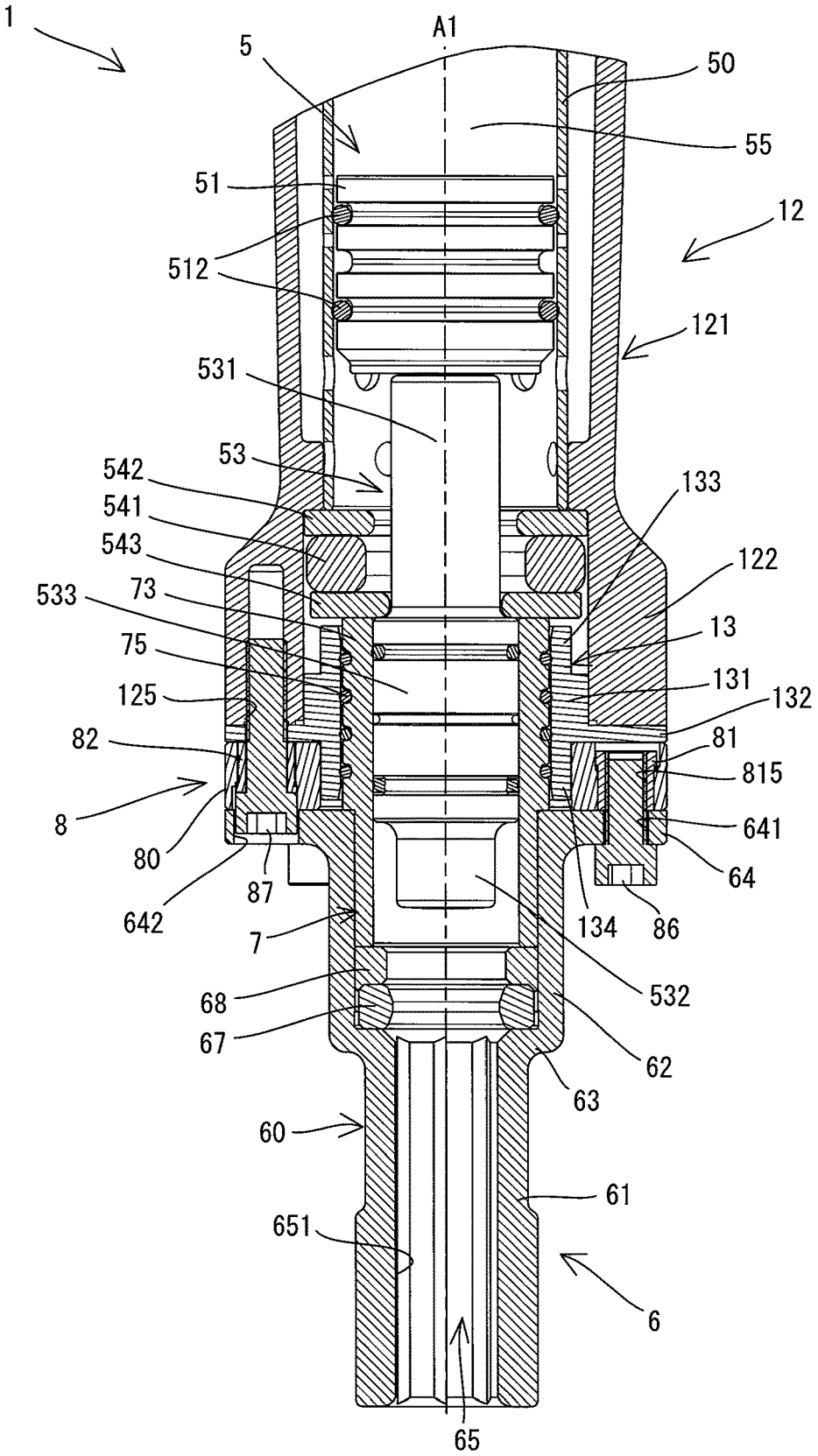
FIG. 3 is a longitudinal sectional view of a lower end portion of the electric hammer.

The barrel 12 has an elongate circular cylindrical shape as a whole. As shown in FIG. 3, in the present embodiment, the barrel 12 includes a cylindrical body 121 extending in the hammering-axis A1 direction (up-down direction) and an outer sleeve 13 which is connected to a lower end portion of the body 121. The body 121 is connected to a lower end portion of the body housing 11 so as to be immovable relative to the body housing 11. It is noted that, in the present embodiment, the body housing 11 and the barrel 12 are made of metal. The lower end portion of the body 121 is formed as a large-diameter part 122 having a larger diameter than an upper portion of the body 121. The outer sleeve 13 includes a cylindrical part 131 and a flange 132. The cylindrical part 131 is a portion that has a circular cylindrical shape. The flange 132 is a portion that protrudes radially outward from a central portion of the cylindrical part 131 in the hammering-axis A1 direction (up-down direction), and has generally the same diameter as the large-diameter part 122. In the following description, an upper portion of the cylindrical part 131 above the flange 132 and a lower portion of the cylindrical part 131 below the flange 132 are referred to as an upper cylindrical part 133 and a lower cylindrical part 134, respectively. The outer sleeve 13 is integrally fixed to the body 121 in a state in which the flange 132 abuts on a lower end surface of the large-diameter part 122 and the upper cylindrical part 133 is fitted in the large-diameter part 122, coaxially with the hammering is A1.

Four second threaded holes 125 are formed in a lower end portion of the barrel 12 (specifically, the flange 132 and the large-diameter part 122) and arranged at equal intervals in a circumferential direction. Each of the second threaded holes 125 is configured such that a second screw 87, which will be described later, can be threadably engaged therewith.

As shown in FIG. 2, the cylinder 50 is a circular cylindrical member disposed in an internal space of the barrel 12, coaxially with the hammering axis A1. Upper and lower end portions of the cylinder 50 are respectively fixed to the body housing 11 and the barrel 12 with a clearance between the cylinder 50 and the barrel 12 in a radial direction.

In the present embodiment, an alternate current (AC) motor is employed as the motor 2 which serves as a driving source for the tool accessory 9. The motor 2 may be driven by power supply from an external AC power source via a power cable 19 (see FIG. 1). Further, as shown in FIG. 2, the motor 2 is disposed in an upper portion of the body housing 11 such that a rotation axis of an output shaft 21 of the motor 2 crosses (more specifically, orthogonally crosses) the hammering axis A1. A controller 20 is disposed between the body housing 11 and the outer housing 15, in the vicinity of the electric switch 161, and electrically connected to the electric switch 161 and the motor 2. The controller 20 is configured to drive the motor 2 and control the rotation speed of the motor 2 when the trigger 162 is depressed and the electric switch 161 is turned on.

The first motion converting mechanism 3 is configured to convert rotation of the output shaft 21 of the motor 2 into linear motion and to transmit it to a striking mechanism 5, which will be described later. In the present embodiment, the first motion converting mechanism 3 is configured to convert rotation of the output shaft 21 into reciprocating motion of a piston 37 to thereby linearly drive a striker 51 in the hammering-axis A1 direction within the cylinder 50. The structure of the first motion converting mechanism 3 is known and therefore only briefly described here. As shown in FIG. 2, the first motion converting mechanism 3 includes a speed reducing mechanism 31, a first shaft 33, an eccentric pin 34, a first rod 36 and the piston 37. The speed reducing mechanism 31 includes a gear train and is configured to reduce the speed of the rotation of the output shaft 21 and to transmit it to the first shaft 33. The first shaft 33 is rotatably supported below the motor 2. The eccentric pin 34 is integrally formed with the first shaft 33. An upper end portion of the first rod 36 extending in the up-down direction is rotatably connected to the eccentric pin 34. The piston 37 to be described below is rotatably connected to a lower end portion of the first rod 36. With such a structure, the piston 37 is caused to reciprocate in the up-down direction when motor 2 is driven.

The second motion converting mechanism 4 is configured to convert rotation of the output shaft 21 of the motor 2 into reciprocating motion of a counterweight 47. The structure of the second motion converting mechanism 4 is also known and therefore only briefly described here. As shown in FIG. 2, the second motion converting mechanism 4 includes a second shaft 43, a second rod 46 and the counterweight 47. The second shaft 43 is coaxially arranged with the first shaft 33 and provided in engagement with the eccentric pin 34 of the first motion converting mechanism 3 to rotate along with rotation of the first shaft 33. An upper end portion of the second rod 46 is rotatably connected to the second shaft 43 via an eccentric pin. The counterweight 47 is rotatably connected to a lower end portion of the second rod 46 via a connecting pin. The counterweight 47 has a generally circular cylindrical shape and is disposed to be slidable along an outer circumferential surface of the cylinder 50. With such a structure, the counterweight 47 is caused to reciprocate in the up-down direction when the motor 2 is driven. It is noted that the counterweight 47 is set to move in an opposite phase to the striker 51 or an impact bolt 53, and thereby suppresses vibration caused during the chipping operation.

The structure of the tool holder 6 is now described with reference to FIGS. 3 and 5. As shown in FIG. 3, the tool holder 6 has a through hole 65 extending in the hammering-axis A1 direction, and is configured to hold the tool accessory 9 (see FIG. 1) inserted into the through hole 65 so as to be movable in the hammering-axis A1 direction. In the present embodiment, the tool holder 6 includes a cylindrical body 60 extending in the hammering-axis A1 direction (up-down direction) and an inner sleeve 7 connected to an upper end portion of the body 60. The tool holder 6 of the present embodiment is made of metal.

The body 60 includes a small-diameter part 61 which forms a lower portion of the body 60, a large-diameter part 62 which forms an upper portion of the body 60 and which has a larger diameter than the small-diameter part 61, and a stepped part 63 which connects the small-diameter part 61 and the large-diameter part 62. A flange 64 is formed on the upper end of the large-diameter part 62 and protrudes radially outward. The flange 64 has substantially the same diameter as the flange 132 of the outer sleeve 13. As shown in FIG. 5, four through holes 641 and four through holes 642 are formed in the flange 64 and alternately arranged at equal intervals in a circumferential direction. Each of the through holes 641 is configured such that a first screw 86, which will be described later, can be inserted therethrough. Each of the through holes 642 is configured such that a head of the second screw 87, which will be described later, can be loosely disposed therein.

The inner sleeve 7 has a circular cylindrical shape and is integrally fixed to the body 60 in a state in which its lower portion is fitted in an upper portion of the large-diameter part 62, coaxially with the hammering axis A1. A portion of the inner sleeve 7 which protrudes upward from the large-diameter part 62 is referred to as a protruding part 73. O-rings 75, which are elastic elements, are fitted on an outer circumferential surface of the protruding part 73. More specifically, four O-rings 75 are respectively fitted in four grooves which are annularly formed in the outer circumferential surface of the protruding part 73. A rubber ring 67, which is an elastic element, is disposed inside a lower end portion of the large-diameter part 62. More specifically, the rubber ring 67 is held between the stepped part 63 and a washer 68 disposed under the inner sleeve 7 in the hammering-axis A1 direction (up-down direction) and prevented from moving in the hammering-axis A1 direction. The hole diameter of the rubber ring 67 is set to be generally equal to the diameter of a base end portion of the tool accessory 9 (an end portion opposite to a tip end portion of the tool accessory 9 which performs a processing operation on a workpiece).

It is noted that a portion of the through hole 65 which extends inside the small-diameter part 61 forms a tool insertion hole 651, through which a shank of the tool accessory 9 having a polygonal section is inserted, and has a sectional shape corresponding to the shank. Rotation of the tool accessory 9 relative to the tool holder 6 can be prevented by fitting the shank of the tool accessory 9 in the tool insertion hole 651. An upper portion of the through hole 65 above the tool insertion hole 651 extends through the rubber ring 67, the washer 68 and the inner sleeve 7, and communicates with the internal space of the barrel 12. It is noted that, when the shank is inserted through the tool insertion hole 651, the base end portion of the tool accessory 9 is disposed within the hole of the rubber ring 67.

As shown in FIG. 3, the tool holder 6 is connected to the lower end portion of the barrel 12 via a connection part 8. Further, the tool holder 6 is disposed such that a portion of the tool holder 6 overlaps the barrel 12 in a radial direction with respect to the hammering axis A1. The structure of connecting the barrel 12 and the tool holder 6 is now described in detail.

First, the structure of connecting the barrel 12 and the tool holder 6 in the radial direction is described. As shown in FIG. 3, almost the whole protruding part 73 of the inner sleeve 7, in the hammering-axis A1 direction, is disposed inside the cylindrical part 131 of the outer sleeve 13. The outer diameter of the inner sleeve 7 is set to be slightly smaller than the inner diameter of the outer sleeve 13, and the four O-rings 75 fitted on the protruding part 73 normally hold the protruding part 73 inside the outer sleeve 13 in a state in which an outer circumferential surface of the protruding part 73 is not in contact with an inner circumferential surface of the outer sleeve 13. As described above, in the present embodiment, a portion of the tool holder 6 is disposed within the barrel 12, and the O-rings 75, which are elastic elements, are interposed between the tool holder 6 and the barrel 12 in the radial direction. In other words, a portion of the tool holder 6 and the barrel 12 are elastically connected to each other via the O-rings 75 (i.e. elastic elements) in the radial direction.

The structure of connecting the barrel 12 and the tool holder 6 in the hammering-axis A1 direction is now described with reference to FIGS. 3 to 6. In the present embodiment, the connection part 8 includes a connecting rubber 80, which is an elastic element, first members 81 and second members 82, and is configured to connect the barrel 12 and the tool holder 6 so as to be movable relative to each other in the hammering-axis A1 direction. It is noted that, in the present embodiment, the first members 81 and the second members 82 are each made of metal. The structures of the connecting rubber 80, the first members 81 and the second members 82 are now described one by one.

Figure 5:
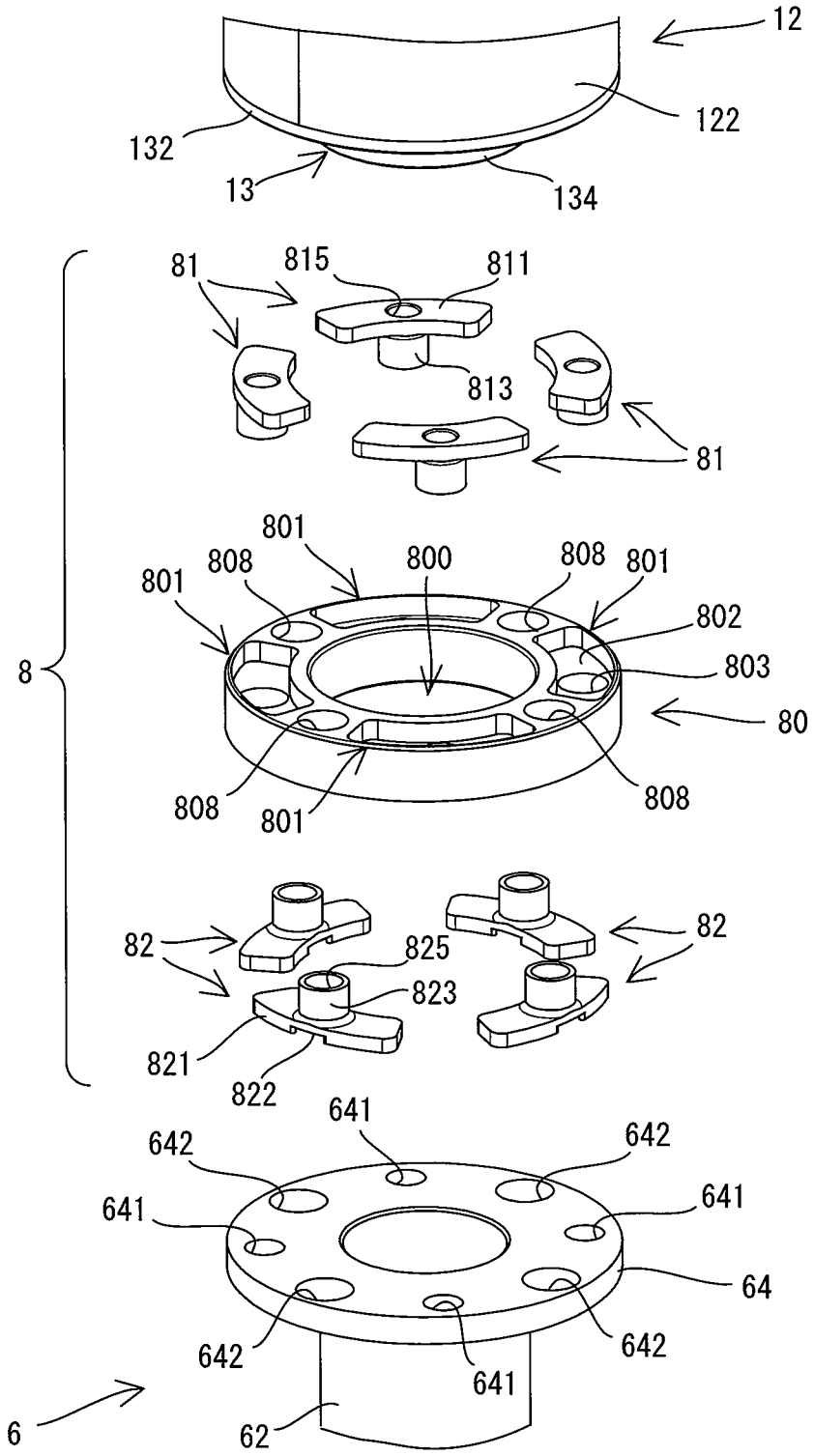
FIG. 5 is an exploded perspective view showing a barrel, a tool holder and a connection part (but not showing an inner sleeve).
Figure 6:
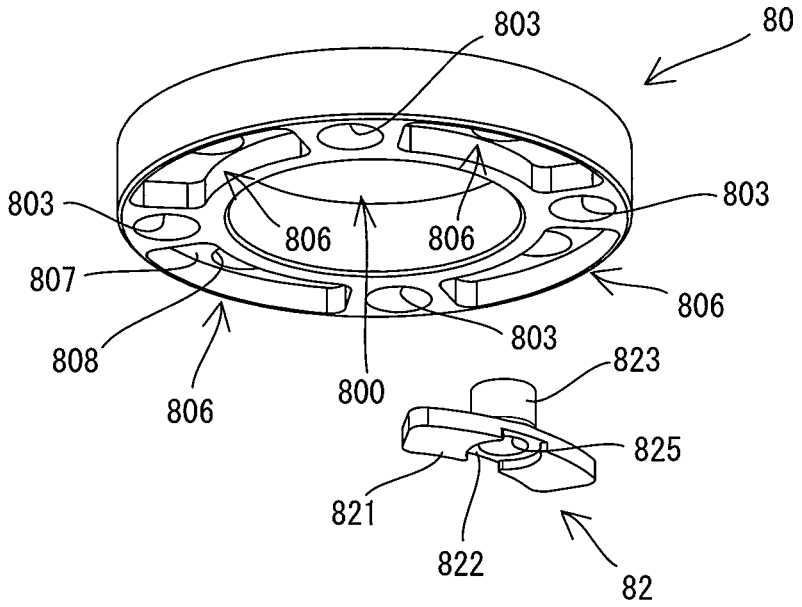
FIG. 6 is an exploded perspective view showing a connecting rubber and a second member.

As shown in FIGS. 5 and 6, the connecting rubber 80 has a circular cylindrical shape as a whole, and has a through hole 800 extending in the hammering saris A1 direction (up-down direction). As shown in FIG. 3, the connecting rubber 80 has an inner diameter generally equal to the outer diameter of the lower cylindrical part 134 of the outer sleeve 13 and has an outer diameter generally equal to the diameter of the flange 132 of the barrel 12 and the diameter of the flange 64 of the tool holder 6. The connecting rubber 80 is fitted onto an outer circumferential surface of the lower cylindrical part 134 of the outer sleeve 13 and is disposed to be held between the barrel 12 and the tool holder 6 from above and below, in a state in which an upper end surface and a lower end surface of the connecting rubber 80 respectively abut on the flange 132 and the flange 64. The connecting rubber 80 is formed to be longer in the hammering-axis A1 direction (up-down direction) than the lower cylindrical part 134. Therefore, a clearance is normally formed between a lower end of the lower cylindrical part 134 and an upper surface of the flange 64 in the hammering-axis A1 direction (up-down direction). This clearance defines a range in which the barrel 12 and the tool holder 6 are allowed to relatively move toward each other in the hammering-axis A1 direction.

As shown in FIGS. 5 and 6, the connecting rubber 80 is provided with four first-member receiving parts 801 and four second-member receiving parts 806. The first-member receiving parts 801 and the second-member receiving parts 806 are alternately arranged in the circumferential direction around the hammering axis A1.

As shown in FIG. 5, each of the first-member receiving parts 801 includes a first recess 802 and a first fitting hole 801. The first recess 802 is recessed downward from an upper end surface of the connecting rubber 80 and has a generally rectangular shape curved along the circumferential direction in a plan view. The first fitting hole 803 is formed in a central portion of the first recess 802 and extends through the connecting rubber 80 in the up-down direction. As shown in FIG. 6, the second-member receiving part 806 includes a second recess 807 and a second fitting hole 808. The second recess 807 is recessed upward from a lower end surface of the connecting rubber 80 and has a generally rectangular shape curved along the circumferential direction in a bottom view. The second fitting hole 808 is formed in a central portion of the second recess 807 and extends through the connecting rubber 80 in the up-down direction. It is noted that the depths of the first recess 802 and the second recess 807 in the up-down direction are set to be about one third of the thickness of the connecting rubber 80 in the up-down direction. The first recesses 802 and the second recesses 807 are arranged such that their end portions in the circumferential direction overlap each other in the hammering-axis A1 direction (up-down direction).

As shown in FIG. 5, the first member 81 includes a first compression part 811, a first connection part 813 and a first threaded hole 815. The first compression part 811 has a generally rectangular plate-like shape curved along the circumferential direction in the plan view, and is configured to be fitted in the first recess 802. The first connection part 813 is a circular cylindrical portion protruding downward from a central portion of the first compression part 811, and is configured to be fitted in the first fitting hole 803. The first threaded hole 815 extends through the central portion of the first compression part 811 and the first connection part 813 in the up-down direction. The first threaded hole 815 is configured such that the first screw 86 (see FIG. 3) can be threadably engaged therewith. The first member 81 is shorter than the connecting rubber 80 and generally as long as the lower cylindrical part 134 of the outer sleeve 13 in the hammering-axis A1 direction (up-down direction).

As shown in FIG. 6, each of the four second members 82 includes a second compression part 821, a second-screw arrangement part 822, a second connection part 823 and a through hole 825. The second compression part 821 has a generally rectangular plate-like shape which is curved along the circumferential direction in the bottom view, and is configured to be fitted in the second recess 807. The second-screw arrangement part 822 is a recess which is recessed upward from a lower surface of the second compression part 821 and has a generally circular shape in the bottom view. The second-screw arrangement part 822 is configured such that the head of the second screw 87 can be loosely disposed therein. The second connection part 823 is a circular cylindrical portion protruding upward from a central portion of the second-screw arrangement part 822, and configured to be fitted in the second fitting hole 808. The through hole 825 extends through the central portion of the second-screw arrangement part 822 and the second connection part 823 in the up-down direction. The through hole 825 is configured such that a shaft of the second screw 87 (see FIG. 3) can be inserted therethrough. The second member 82 is shorter than the connecting rubber 80 and generally as long as the lower cylindrical part 134 of the outer sleeve 13 in the hammering-axis A1 direction (up-down direction).

The first and second members 81, 82 configured as described above are assembled to the connecting rubber 80 to form the connection part 8. Specifically, the first members 81 are fitted in the first-member receiving parts 801 from above and the second members 82 are fitted in the second-member receiving parts 806, so that the connection part 8 is formed as one unit. Subsequently, as shown in FIG. 3, the connection part 8 is fitted onto the lower cylindrical part 134, and the inner sleeve 7 is fitted in the outer sleeve 13. In this positioned state, the first screws 86 are inserted through the through holes 641 and threadably engaged with the first threaded holes 815, so that the first members 81 are fixed to the tool holder 6. It is noted that the length of the shaft of the first screw 86 is set such that the shaft does not protrude upward from the first member 81. Therefore, a clearance is formed in the up-down direction between an upper end of the first member 81 and the flange 132 of the barrel 12. This clearance defines the range in which the barrel 12 and the tool holder 6 are allowed to relatively move toward each other in the hammering-axis A1 direction. Further, the second screws 87 are threadably engaged with the second threaded holes 125, so that the second members 82 are fixed to the barrel 12. The second screws 87 are threadably engaged with the second threaded holes 125 from the tool holder 6 side across the connection part 8, but the second screws 87 are not fixed to the tool holder 6.

Figure 4:
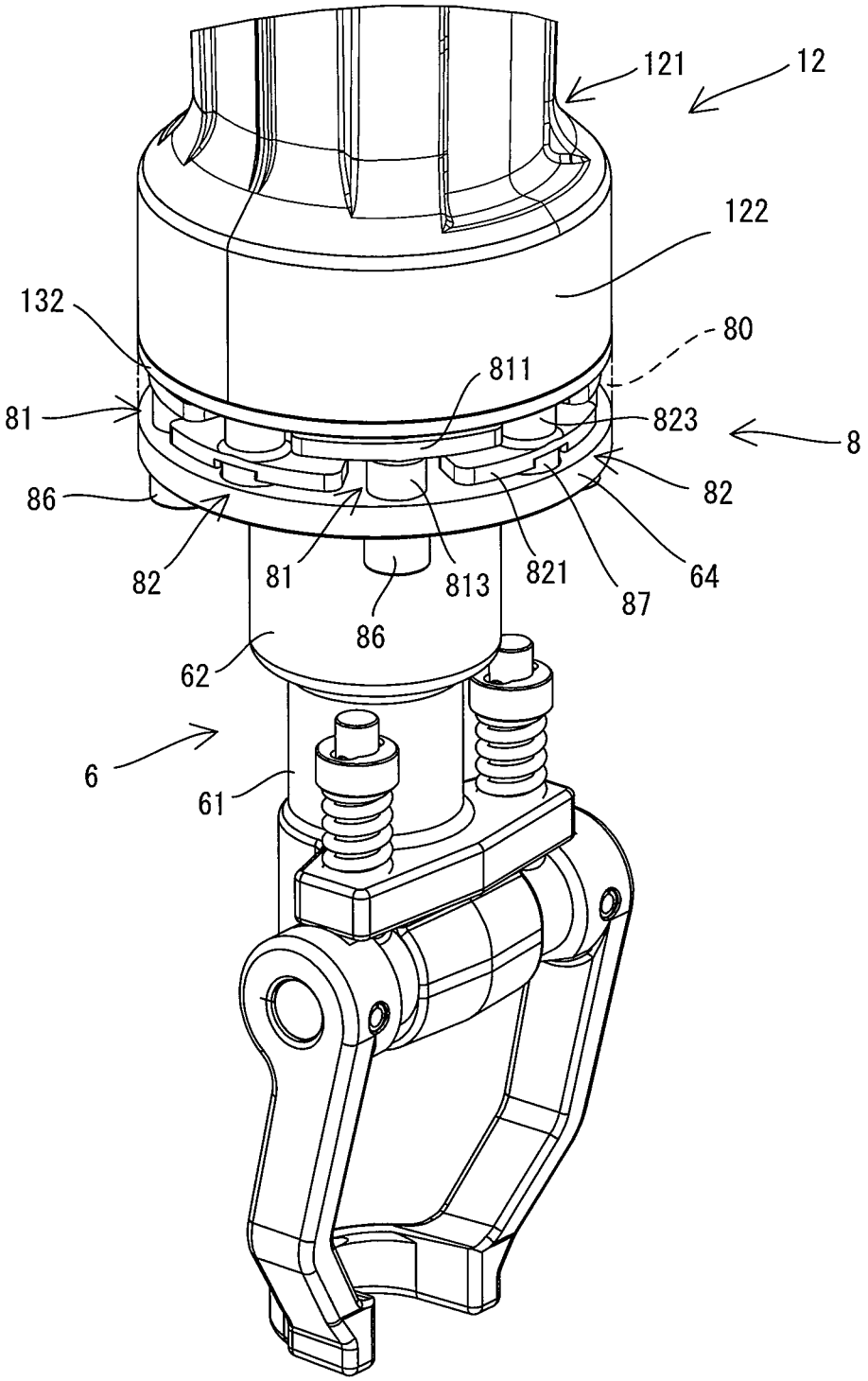
FIG. 4 is a perspective view of the lower end portion of the electric hammer.

When the barrel 12 and the tool holder 12 are connected to each other via the connection part 8 as described above, the connecting rubber 80 is sandwiched between the barrel 12 and the tool holder 12 (more specifically, between the flange 132 and the flange 64) in the hammering-axis A1 direction. Further, the first compression parts 811 of the first members 81 and the second compression parts 821 of the second members 82 are arranged to partly overlap in the hammering-axis A1 direction (up-down direction). More specifically, as shown in FIG. 4, end portions of the first compression parts 811 in the circumferential direction and end portions of the second compression parts 821 in the circumferential direction are arranged to overlap each other in the up-down direction, and portions of the connecting rubber 80 are interposed between the end portions of the first compression parts 811 and the second compression parts 821.

With such an arrangement, when the barrel 12 and the tool holder 6 relatively move toward each other, the portions of the connecting rubber 80 which are interposed between the barrel 12 and the tool holder 6 (more specifically, between the flange 132 and the flange 64) are compressed. On the other hand, when the barrel 12 and the tool holder 6 relatively move away from each other, the portions of the connecting rubber 80 which are interposed between the first compression parts 811 and the second compression parts 821 are compressed. Thus, the connecting rubber 80 is interposed between the barrel 12 and the tool holder 6 so as to be compressed not only when the barrel 12 and the tool holder 6 relatively move in a direction toward each other, but also when the barrel 12 and the tool holder 6 relatively move in a direction away from each other.

The structure of the striking mechanism 5 is now described with reference to FIGS. 2 and 3. The striking mechanism 5 includes the striker 5 which is configured to be driven by the first motion converting mechanism 3, and the impact bolt 53 which is configured to transmit kinetic energy of the striker 51 to the tool accessory 9.

As shown in FIG. 2, the piston 37 and the striker 51 are disposed within the cylinder 50 so as to be slidable in the hammering-axis A1 direction (up-down direction). It is noted that the piston 37 is connected to the first rod 36 above the striker 51 and configured to be reciprocated in the up-down direction within the cylinder 50 by the first rod 36.

The striker 51 is configured to linearly move the impact bolt 53 by colliding with the impact bolt 53. As shown in FIG. 3, in the present embodiment, the striker 51 as a whole has a generally circular column shape, and has a slightly smaller diameter than the inner diameter of the cylinder 50. A plurality of O-rings 512, which are elastic elements, are fitted on an outer circumferential surface of the striker 51. More specifically, three annular grooves are formed in the outer circumferential surface of the striker 51, and two O-rings 512 are respectively fitted in uppermost and lowermost ones of the three grooves. In this state, the two O-rings 512 can slide in the hammering-axis A1 direction along an inner circumferential surface of the cylinder 50. Further, the O-rings 512 hold the striker 51 within the cylinder 50, in a state hi which the outer circumferential surface of the striker 51 is not in contact with the inner circumferential surface of the cylinder 50.

As shown in FIG. 2, an air chamber 55 is formed between the piston 37 and the striker 51 and serves to linearly move the striker 51 by pressure fluctuations of air, which is caused by a reciprocating movement of the piston 37. In the present embodiment, the two O-rings 521 fitted on the striker 51 are each configured to also serve as a sealing member for maintaining airtightness of the air chamber 55.

The impact bolt 53 is disposed to be linearly movable in the hammering-axis A1 direction, and configured to drive the tool accessory 9 in the hammering-axis A1 direction by colliding with the tool accessory 9. As shown in FIG. 3, in the present embodiment, the impact bolt 53 is formed as a stepped circular column member, and includes an upper end part 531, a lower end part 532 and a central part 533. Each of the upper end part 531, the lower end part 532 and the central part 533 has a circular column shape, but the upper end part 531 and the lower end part 532 have a smaller diameter than the central part 533. At least the lower end part 532, which collides with the tool accessory 9, and the central part 533 of the impact bolt 53 are disposed within the tool holder 6 (specifically, the inner sleeve 7). The diameter of the central part 533 is substantially equal to the inner diameter of the inner sleeve 7. The impact bolt 53 is configured to be slidable within the inner sleeve 7 in a state in which an outer circumferential surface of the central part 533 is held in contact with the inner circumferential surface of the inner sleeve 7.

It is noted that, as shown in FIG. 3, a rubber ring 541, which is an elastic element, is disposed within the barrel 12, between the cylinder 50 and the inner sleeve 7. Annular washers 542, 543 are disposed on the upper and lower sides of the rubber ring 541, respectively. The inner diameter of the washer 542 is smaller than the diameter of the striker 51. Therefore, when the striker 51 moves downward, a front end of the striker 51 abuts on the washer 542, so that the striker 51 is prevented from further loving downward. Further, the inner diameter of the washer 543 is slightly larger than the diameter of the upper end part 531 of the impact bolt 53 and smaller than the diameter of the central part 533. Therefore, when the impact bolt 53 moves upward, the central part 533 abuts on the washer 543, so that the impact bolt 53 is prevented from further moving upward.

Operations of the hammer 1 having the above-described structure and operations of the various elastic elements (the connecting rubber 80, the O-rings 75, the O-rings 512, the rubber ring 67, the rubber ring 541) of the hammer 1 are now described.

User holds the handle 16, pushes down the body 10 and presses the tool accessory 9 against a workpiece. Then, the impact bolt 53 is pushed upward together with the tool accessory 9, an upper end of the central part 533 abuts on the washer 543 and is elastically held by the rubber ring 541. Thus, the impact bolt 53 is prevented from further moving upward, so that the body 10 is positioned with respect to the workpiece in the hammering-axis A1 direction.

When the trigger 162 is depressed and the motor 2 is driven, the piston 37 is caused to reciprocally slide within the cylinder 50 by the first motion converting mechanism 3. As a result, pressure fluctuations of the air in the air chamber 55 occur, and thereby cause the striker 51 to linearly move. Specifically, when the piston 37 is moved downward, the air in the air chamber 55 is compressed so that the internal pressure increases. Therefore, the striker 51 is pushed downward at high speed, in a state in which the O-rings 512 slide along the inner circumferential surface of the cylinder 50, and collides with the impact bolt 53.

When the striker 51 collides with the impact bolt 53, the impact bolt 53 moves downward and collides with the tool accessory 9, so that the kinetic energy of the striker 51 is transmitted to the tool accessory 9. Then, the tool accessory 9 is linearly driven along the hammering axis A1 and strikes the workpiece. On the other hand, when the piston 37 is moved upward by the first motion converting mechanism 3, the air in the air chamber 55 expands so that the internal pressure decreases and the striker 51 is retracted upward. By thus repeating the hammering operation, the hammer 1 performs the chipping operation on the workpiece.

During the chipping operation, vibration is caused in the tool accessory 9 due to impact of collision of the impact bolt 53 and reaction force from the workpiece. The vibration of the tool accessory 9 is directly transmitted to the tool holder 6 which holds the tool accessory 9. The barrel 12 connected to an upper portion of the tool holder 6 has a circular cylindrical shape having an internal space. In such a structure, if the vibration of the tool holder 6 is transmitted to the barrel 12, noise is liable to increase. Further, the barrel 12 has a relatively large outer surface which is exposed to the outside and is formed of metal. Consequently, the noise is especially liable to increase.

In order to cope with this, in the present embodiment, the tool holder 6 and the barrel 12 are connected in the hammering-axis A1 direction via the connecting rubber 80, which is an elastic element, so as to be movable relative to each other. Among vibrations caused in the hammer 1 in which the tool accessory 9 is linearly driven in the hammering-axis A1 direction, vibration in the hammering-axis A1 direction is the largest and most dominant. By provision of the above-described structure, the tool holder 6 and the barrel 12 can move relative to each other in the same direction as this vibration, so that transmission of this vibration from the tool holder 6 to the barrel 12 can be effectively suppressed. Further, vibration is also caused in the impact bolt 53 due to the impact of collision with the tool accessory 9. In order to cope with this, in the present embodiment, the O-rings 75, which are elastic elements, are interposed between the impact bolt 53 and the barrel 12 in the radial direction with respect to the hammering axis A1. In other words, the impact bolt 53 and the barrel 12 are elastically connected in the radial direction via the O-rings 75 (elastic elements). Such a structure can suppress transmission of the vibration from the impact bolt 53 to the barrel 12 in the radial direction. By thus suppressing the transmission of the vibrations from the tool accessory 9 and the impact bolt 53 to the barrel 12, noise which might otherwise arise from vibration of the barrel 12 can be reduced.

Further, like in the present embodiment, in a structure in which a portion (specifically, the inner sleeve 7) of the tool holder 6 is disposed between the impact bolt 53 and the barrel 12 (specifically, the outer sleeve 13) in the radial direction, the vibration transmitted from the tool accessory 9 to the tool holder 6 and the vibration transmitted from the impact bolt 53 to the tool holder 6 may be transmitted to the barrel 12 in the radial direction. In order to cope with this, in the present embodiment, the O-rings 75 are interposed between the portion (the inner sleeve 7) of the tool holder 6 and the barrel 12 (the outer sleeve 13) to elastically connect them, so that transmission of the vibration to the barrel 12 can be further effectively suppressed and noise can be reduced. Further, the protruding part 73 of the inner sleeve 7 is formed to be relatively long with respect to the whole length of the tool holder 6 in the hammering axis A1 direction, and almost the whole protruding part 73 is connected to the inside of the cylindrical part 131 of the outer sleeve 13 via the O-ring 75. Therefore, sufficient resistance against bending moment can be maintained.

As described above, in the hammer 1, the vibration in the hammering-axis A1 direction is the largest and most dominant. In order to cope with this, the connecting rubber 80 is interposed between the barrel 12 and the tool holder 6 such that the connecting rubber 80 is compressed when the barrel 12 and the tool holder 6 relatively move in either direction toward or away from each other in the hammering-axis A1 direction. Generally, rubber has higher bearing force in a compression direction than in a tensile direction. Therefore, with such a structure, durability of the connecting rubber 80 can be favorably maintained.

In the present embodiment, the connecting rubber 80 is held between the tool holder 6 and the barrel 12 by the first members 81 and the second members 82, such that the connecting rubber 80 is partly interposed between the first compression parts 811 and the second compression parts 821 in the hammering-axis A1 direction. With this structure, the connecting rubber 80 can be compressed when the barrel 12 and the tool holder 6 relatively move in either direction toward or away from each other. Further, the four first members 81 and the four second members 82 are alternately arranged in the circumferential direction around the hammering axis A1. Therefore, the tool holder 6 and the barrel 12 can move relative to each other in a well-balanced manner along the hammering axis A1.

The hammer 1 of the present embodiment has the cylinder 50 disposed in the internal space of the barrel 12 and is configured such that the columnar striker 51 disposed within the cylinder 50 collides with the impact bolt 53. The striker 51 can move within the cylinder 50 while being held in a non-contact state with respect to the inner circumferential surface of the cylinder 50 by the two O-rings 512, which are slidable in the hammering-axis A1 direction along the inner circumferential surface of the cylinder 50. Vibration is also caused in the striker 51 when the striker 51 collides with the impact bolt 53. In order to cope with this, the two O-rings 512, which are elastic elements, are provided to prevent the striker 51 from tilting with respect to the hammering axis A1 while moving, and also to suppress transmission of the vibration from the striker 51 to the cylinder 50 and thus to the barrel 12 and reduce the noise. The O-ring 512 is a holding member for holding the striker 51 as described above, and also serves as a sealing member for maintaining airtightness of the air chamber 55. Therefore, it is not necessary to additionally and separately provide a sealing member which is required for a structure using pressure fluctuations of the air in the air chamber 55 to move the striker 51.

In a case where a known structure is employed in which the outer circumferential surface of the striker 51 slides along the inner circumferential surface of the cylinder 50, it is necessary to polish the outer circumferential surface of the striker 51 so as to make the diameter of the striker 51 substantially equal to the inner diameter of the cylinder 50.

However, in a structure in which the diameter of the striker 51 is smaller than the inner diameter of the cylinder 50 and the striker 51 is moved by the sliding movement of the O-rings 512, like in the present embodiment, such a strict dimensional accuracy is not required for the striker 51, which facilitates manufacturing the striker 51.

The rubber ring 67 disposed within the lower end portion of the large-diameter part 62 of the tool holder 6 elastically holds the base end portion of the tool accessory 9 disposed within the tool holder 6 and thereby suppresses a radial swinging movement of the tool accessory 9 which is caused by reaction force froth the workpiece. Thus, vibration and noise which might be otherwise caused by collision of the tool accessory 9 with the tool holder 6 can be reduced.

The rubber ring 541 is held between the lower end of the cylinder 50 disposed within the barrel 12 and the upper end of the tool holder 6 (the inner sleeve 7). Therefore, when the tool holder 6 and the barrel 12 move in the hammering-axis A1 direction relative to each other, the rubber ring 541 can suppress transmission of the vibration of the tool holder 6 to the cylinder 50 and thus to the barrel 12 and thereby reduce noise.

Correspondences between the features of the embodiment and the features of the invention are as follows. The hammer 1 is an example that corresponds to the "impact tool" according to the present invention. The tool holder 6 is an example that corresponds to the "tool-accessory holding part" according to the present invention. The barrel 12 is an example that corresponds to the "body" according to the present invention. The impact bolt 53 is an example that corresponds to the "first hammering member" according to the present invention. The connecting rubber 80 is an example that corresponds to the "first elastic element" according to the present invention. The O-ring 75 is an example that corresponds to the "second elastic element" according to the present invention. The first member 81 and the second member 82 are examples that correspond to the "first member" and the "second member", respectively, according to the present invention. The cylinder 50 is an example that corresponds to the "circular cylindrical member" according to the present invention. The striker 51 is an example that corresponds to the "second hammering member" according to the present invention. The O-ring 512 is an example that corresponds to the "third elastic element" according to the present invention.

The above-described embodiment is a mere example and an impact tool according to the present invention is not limited to the structure of above-described the hammer 1. For example, the following modifications may be made. Note that one or more of these modifications may be employed in combination with the hammer 1 of the above-described embodiment or the invention as defined in any one of the claims.

For example, in the above-described embodiment, a portion (the inner sleeve 7) of the tool holder 6 is disposed between the impact bolt 53 and the barrel 12 (the outer sleeve 13), and the O-rings 75 (elastic elements) are interposed between the inner sleeve 7 and the outer sleeve 13. However, the arrangement relation between the impact bolt 53, the tool holder 6 and the barrel 12 may be appropriately changed, as long as an elastic element is interposed between the impact bolt 53 and the barrel 12 in the radial direction with respect to the hammering axis A1.

Figure 7:
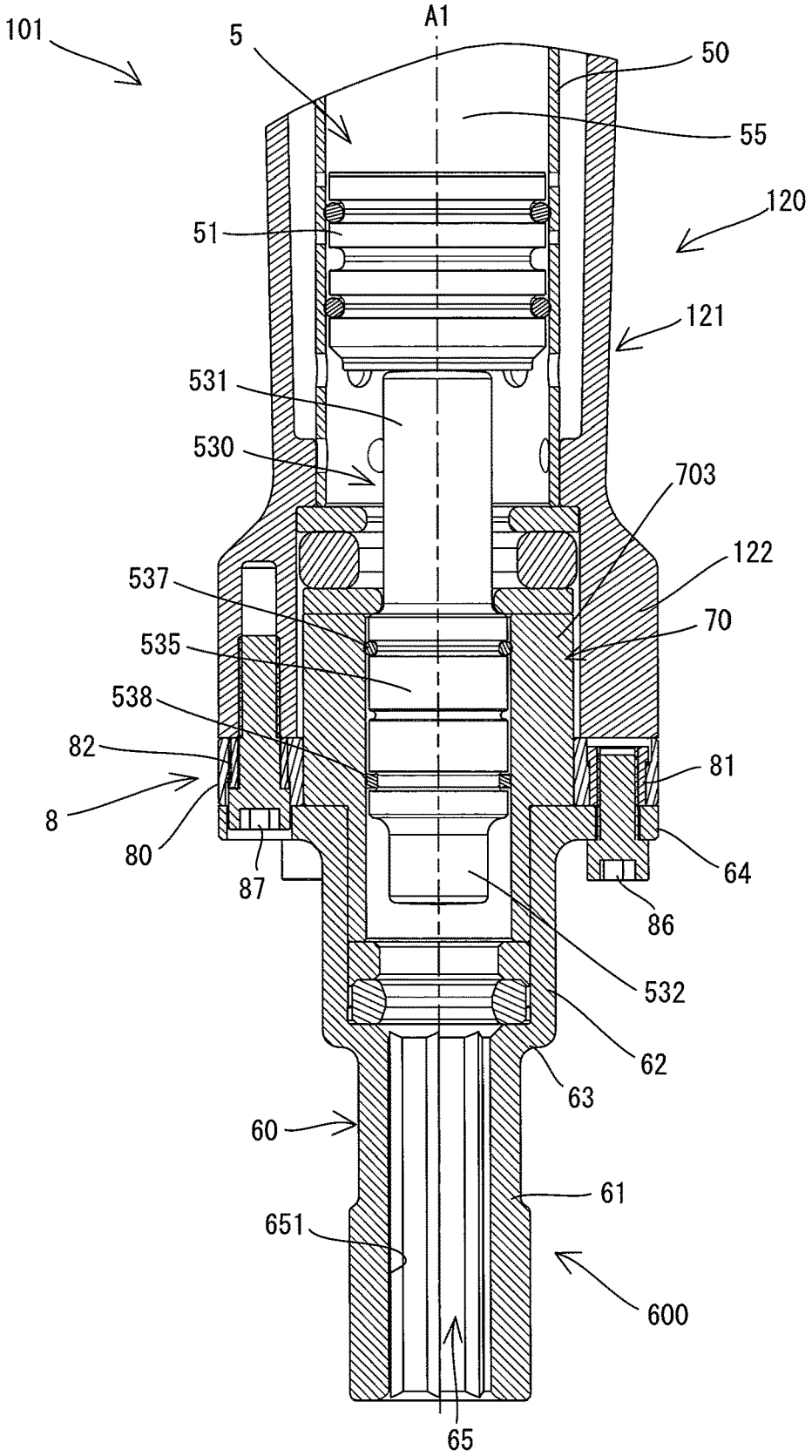
FIG. 7 is a longitudinal sectional view of a lower end portion of an electric hammer according to a modification.

For example, in a hammer 101 according to a modification shown in FIG. 7, a barrel 120 is not provided with the outer sleeve 13 of the above-described embodiment, and the barrel 120 is formed by a body 121 which has a slightly longer large-diameter part 122 but otherwise has the same structure as that of the above-described embodiment. Further, a tool holder 600 includes a body 60 having the same structure as that of the above-described embodiment and an inner sleeve 70 having a different structure from that of the above-described embodiment. The inner sleeve 70 is configured to have a protruding part 703 having a larger outer diameter than that of the inner sleeve 7 of the above-described embodiment to reduce a clearance between the inner sleeve 70 and the large-diameter part 122 in the radial direction. In the present modification, the connecting rubber 80 is fitted onto the outer circumferential surface of the protruding part 703. The structure of the connection part 8 and the manner of connecting the barrel 120 and the tool holder 600 by the connection part 8 are the same as in the above-described embodiment and therefore not described here.

Further, in an impact bolt 530 of the present modification, unlike in the above-described embodiment, the diameter of a central part 535 is slightly smaller than the inner diameter of the inner sleeve 70. An O-ring 537 and a slide ring 538 are fitted on an outer circumferential surface of the central part 535. More specifically, three annular grooves are formed in the outer circumferential surface of the central part 535, and the O-ring 537 and the slide ring 538, which are both elastic elements, are respectively fitted in uppermost and lowermost ones of the three grooves. The O-ring 537 and the slide ring 538 on the impact bolt 530 can slide in the hammering-axis A1 direction along an inner circumferential surface of the inner sleeve 70. Further, the O-ring 537 and the slide ring 538 hold the impact bolt 530 within the inner sleeve 70 in a state in which the outer circumferential surface of the impact bolt 530 is not in contact with the inner circumferential surface of the inner sleeve 70.

In the present modification, when vibration is caused in the impact bolt 530 due to the impact of collision with the tool accessory 9, the O-ring 537 and the slide ring 538 can suppress transmission of the vibration from the impact bolt 530 to the tool holder 600 (the inner sleeve 70) and thereby reduce transmission of the vibration to the barrel 120 and thus reduce noise. Further, like the striker 51 of the above-described embodiment, the impact bolt 530 does not require strict dimensional accuracy, which facilitates remanufacturing the impact bolt 530.

In the present modification, the tool holder 600 is an example that corresponds to the "tool-accessory holding part" according to the present invention. The barrel 120 is an example that corresponds to the "body" according to the present invention. The impact bolt 530 is an example that corresponds to the "first hammering member" according to the present invention. Each of the O-ring 537 and the slide ring 538 is an example that corresponds to the "second elastic element" according to the present invention.

Further, for example, in a structure in which no portion of the tool holder 600 is interposed between the impact bolt 530 and the barrel 120, and the impact bolt 530 can slide within the barrel 120, like in the modification shown in FIG. 7, the O-ring 537 and the slide ring 538 (elastic elements) may be interposed between the impact bolt 530 and the barrel 120.

In the above-described embodiment and modifications, a plurality of elastic elements (the four O-rings 75, the O-ring 537 and the slide ring 538) are interposed between the impact bolt 53, 530 and the barrel 12, 120 in the radial direction, but the number of the elastic elements interposed between the impact bolt 53, 530 and the barrel 12, 120 may be changed. In the modification shown in FIG. 7, however, in order to avoid the impact bolt 530 from tilting with respect to the hammering axis A1 while moving, it may be preferable to employ an elastic element which is formed wider to some extent, or to employ a plurality of elastic elements which are arranged at plural positions in the hammering-axis A1 direction.

Likewise, the number of the O-rings 512 for the striker 51 is not limited to two, and only one O-ring 512, or three or more O-rings 512 may be used. In order to avoid the striker 51 from tilting with respect to the hammering axis A1 while moving, however, like those for the impact bolt 530 as described above, it may be preferable to employ an O-ring 512 which is formed wider to some extent, or to employ a plurality of O-rings 512 which are arranged at plural positions in the hammering-axis A1 direction. Further, the elastic element which serves to hold the striker 51 in a state in which the outer circumferential surface of the striker 51 is kept in a non-contact state with respect to the inner circumferential surface of the cylinder 50 does not need to also serve as a sealing member for the air chamber 55. In a case where a plurality of elastic elements are provided, at least one of the elastic elements may also serve as the sealing member for the air chamber 55. For example, an uppermost one (on the air chamber 55 side) of the elastic elements may be the O-ring 512, and other elastic elements may be fixed to the outer circumferential surface of the striker 51 at plural positions in the circumferential direction on the lower side of the uppermost one.

The striker 51 does not need to be formed in a circular column shape as a whole, and may include a portion which is formed in a circular column shape. For example, the front end portion of the striker 51 which collides with the impact bolt 53, 530 may have a smaller diameter than the body having a circular column shape. Further, in place of the striker 51, a conventional striker configured such that its outer circumferential surface slides along the inner circumferential surface of the cylinder 50 may be employed, as the second hammering member for driving the impact bolt 53, 530.

The structure of connecting the tool holder 6 and the barrel 12 in the hammering-axis A1 direction so as to be movable relative to each other is not limited to the connection part 8 including the connecting rubber 80. For example, the tool holder 6 and the barrel 12 may be connected via a spring, which is an elastic element, so as to be movable relative to each other in the hammering-axis A1 direction. Further, the connection part 8 includes the four first members 81 and the four second members 82, but their shapes, numbers and arrangement positions relative to the connecting rubber 80 may be appropriately changed. In order to realize a structure in which the elastic element can be compressed when the barrel 12 and the tool holder 6 relatively move in either direction toward or away from each other, however, it may be preferable that the first member 81 fixed to the tool holder 6 and the second member 82 fixed to the barrel 12 are configured such that at least a portion of the second member 82 is disposed between the tool holder 6 and at least a portion of the first member 81. Further, the barrel 12 and the tool holder 6 may be provided with respective structures of holding the elastic element, in place of the first and second members 81, 82.

A hammer 102 having an exemplary connection structure in place of the connection part 8 is now described with reference to FIGS. 8 to 12. The hammer 102 according to the present modification is different from the above-described embodiment mainly in the structures of a barrel 14 and a tool holder 605 and the structure of connecting the barrel 14 and the tool holder 605. In the following description, structures identical to those in the hammer 1 are not described and different structures are mainly described.

Figure 8:
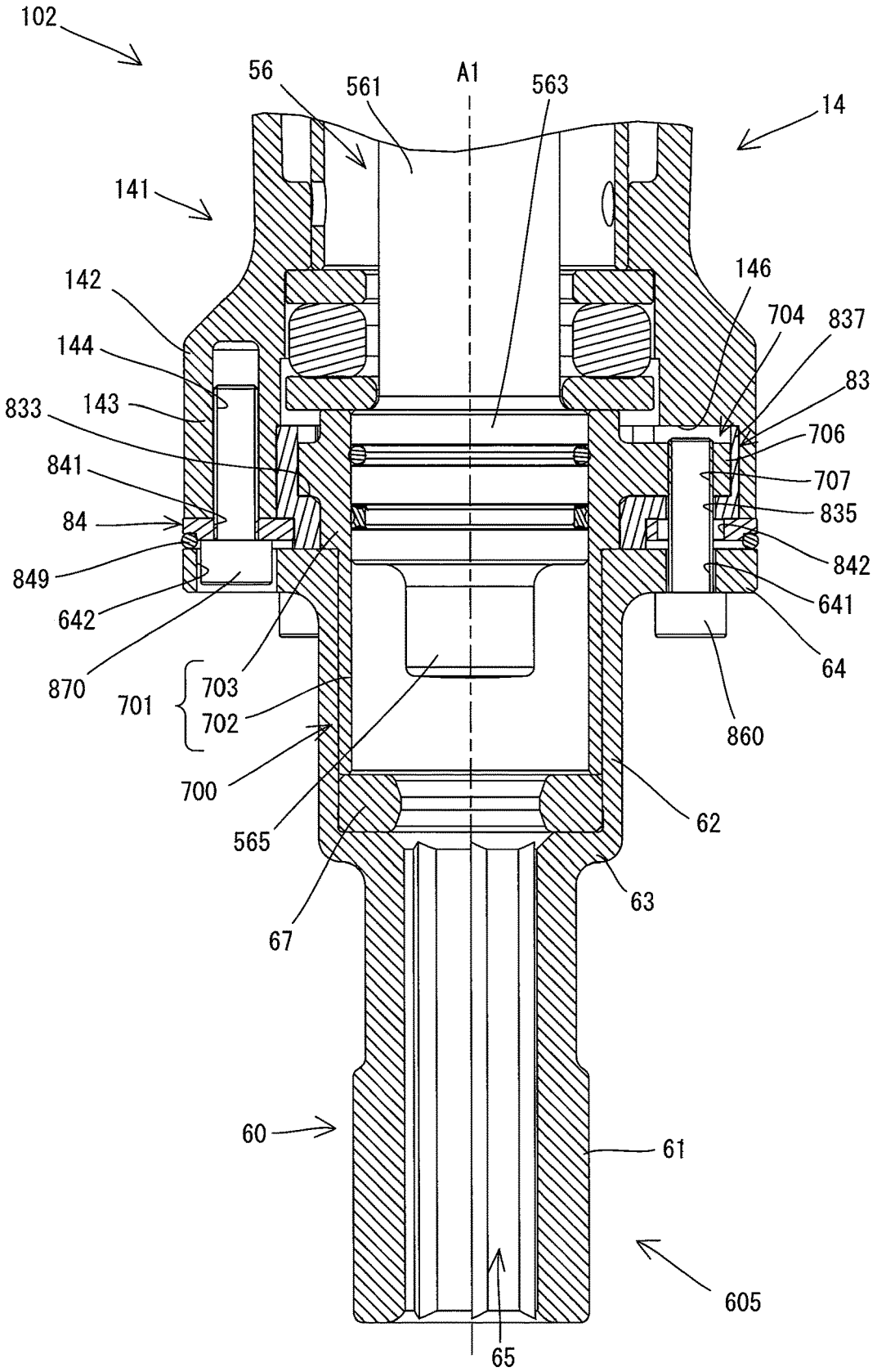
FIG. 8 is a longitudinal sectional view of a lower end portion of an electric hammer according to another modification.
Figure 9:
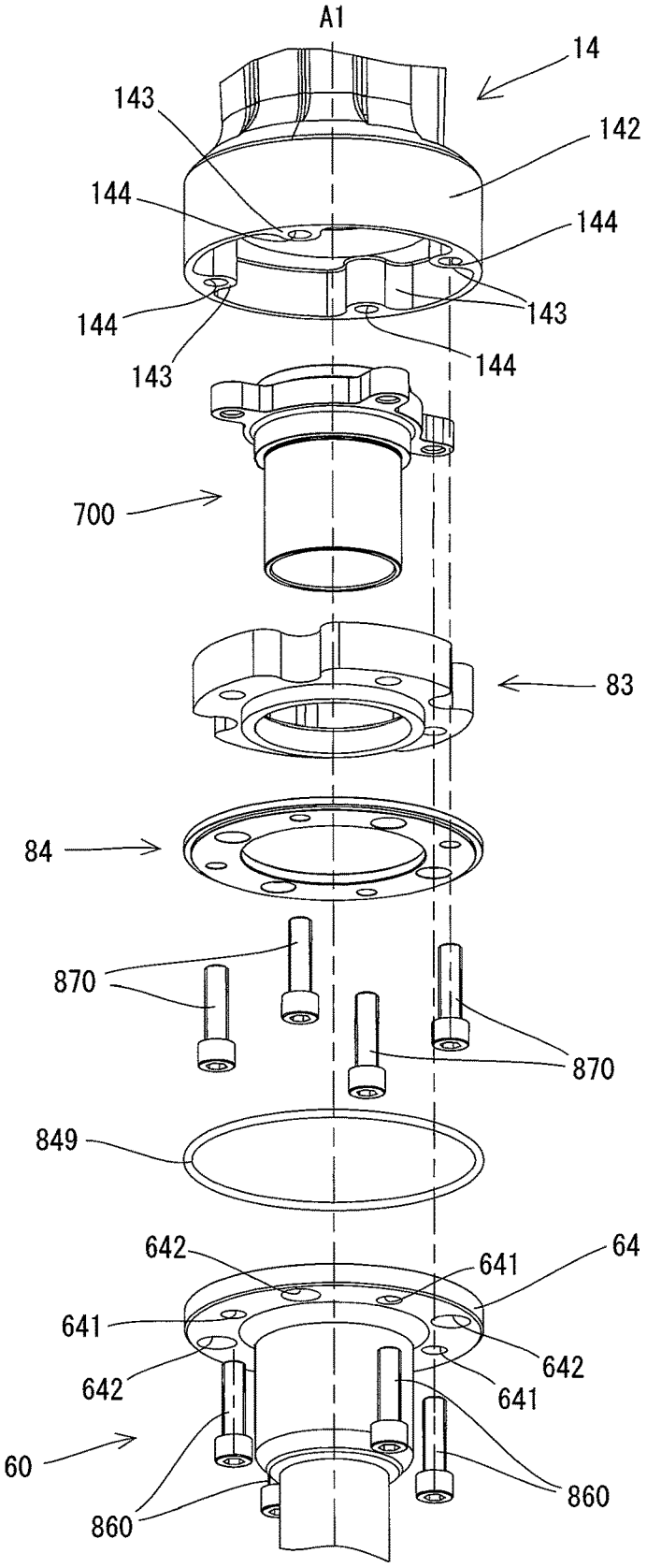
FIG. 9 is an exploded perspective view of the lower end portion of the electric hammer shown in FIG. 8.

First, the structure of the barrel 14 is described. As shown in FIG. 8, unlike the hammer 1 (see FIG. 3), the hammer 102 does not have an outer sleeve connected to a body 141 of the barrel 14. The body 141 is connected to the lower end portion of the body housing 11 (see FIG. 2) and extends in the hammering-axis A1 direction (up-down direction). A lower end portion of the body 141 is formed as a large-diameter part 142 having a larger diameter than an upper portion of the body 141. The large-diameter part 142 has substantially the same diameter as the flange 64 of the tool holder 605, which will be described later. As shown in FIG. 9, four screw fastening parts 143 are formed on an inner circumferential portion of the lower end portion of the large-diameter part 142. The screw fastening parts 143 protrude radially inward (toward the hammering axis A1). In the present modification, the screw fastening parts 143 are arranged at equal intervals in the circumferential direction around the hammering axis A1. A second threaded hole 144 is formed in a central portion of each of the screw fastening parts 143 and extends upward from a lower end surface of the screw fastening part 143. The second threaded hole 144 is configured such that a second screw 870, which will be described later, can be threadably engaged therewith.

Figure 11:
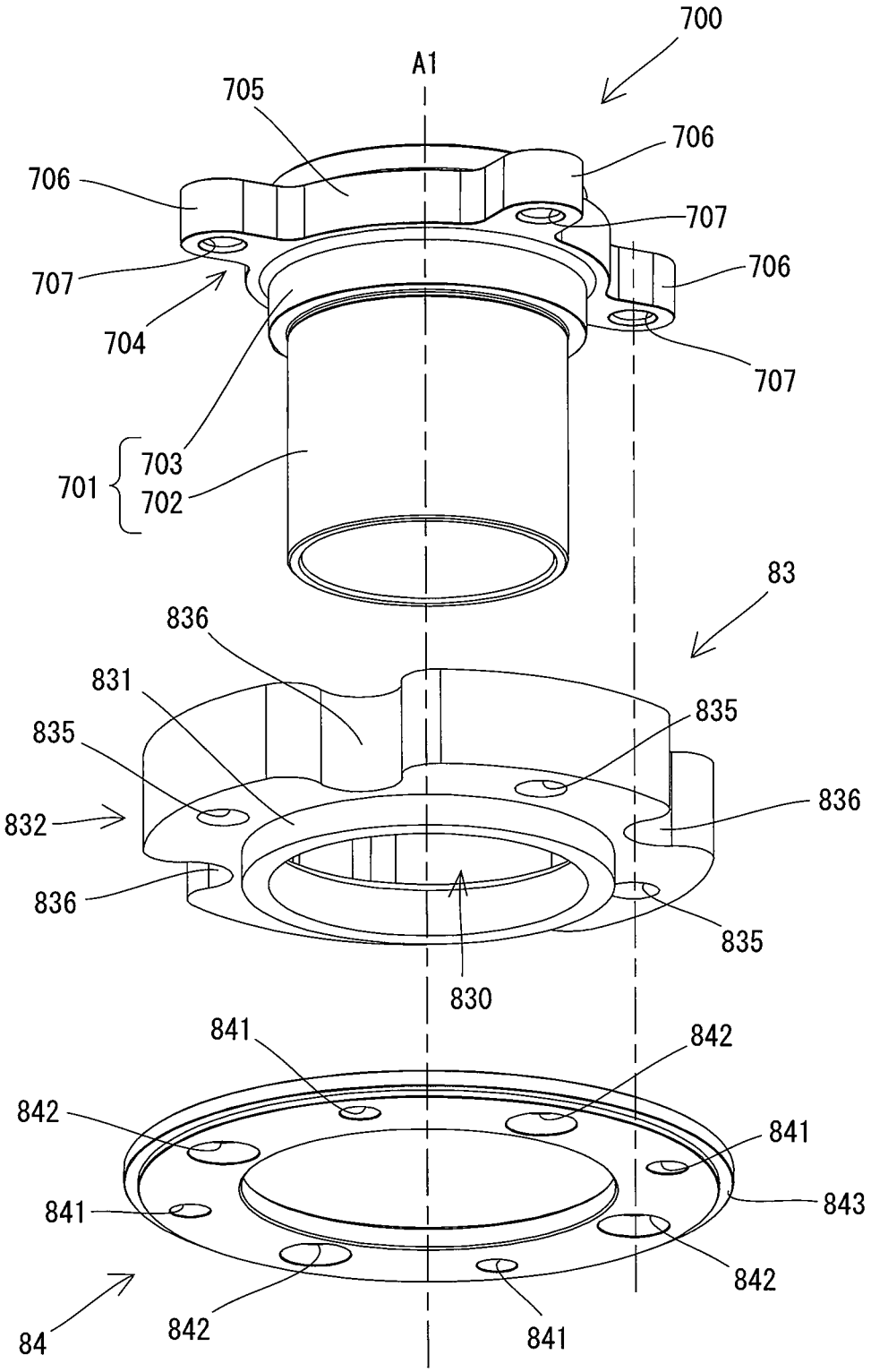
FIG. 11 is a partial enlarged view of FIG. 9.
Figure 12:
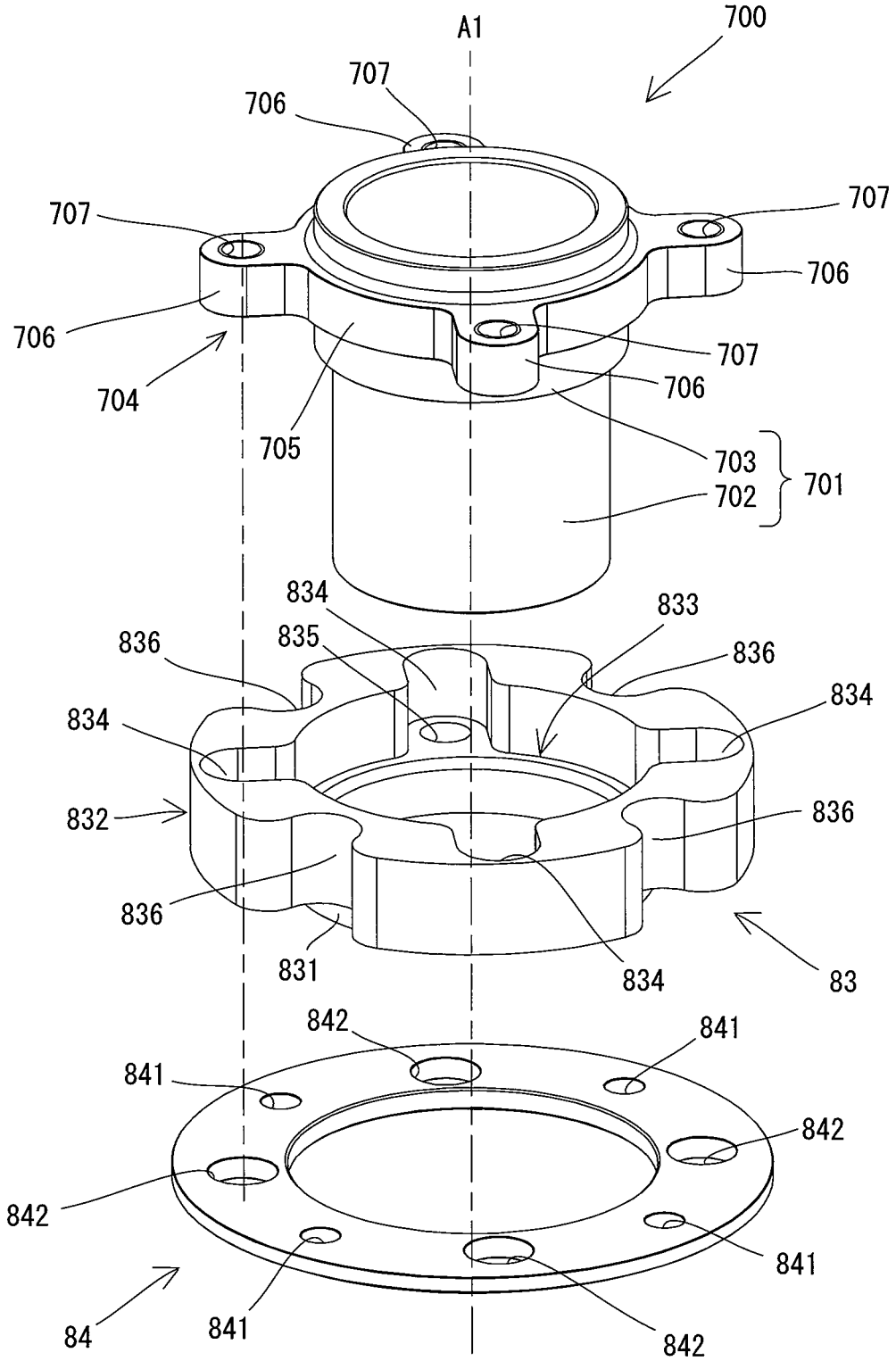
FIG. 12 is a partial enlarged view of FIG. 10.

The structure of the tool holder 605 is now described. As shown in FIG. 8, the tool holder 605 of the present modification includes a body 60 having the sale structure as that of the above-described embodiment and an inner sleeve 700. The inner sleeve 700 has a circular cylindrical shape as a whole, and is configured to slidably guide an impact bolt 56 in the hammering-axis A1 direction. In the present modification, the impact bolt 56 is configured as a stepped circular column member which includes an upper end part 561, a central part 563 and a lower end part 565. The impact bolt 56 has the central part 563 shorter than the central part 533, but otherwise has the substantially same structure as the impact bolt 53 (see FIG. 3) of the above-described embodiment. As shown in FIGS. 8, 11 and 12, the inner sleeve 700 includes a cylindrical part 701 having a circular cylindrical shape and a connecting flange 704 integrally formed with the cylindrical part 701.

As shown in FIGS. 8, 11 and 12, the cylindrical part 701 includes a fitted part 702 and a protruding part 703. The fitted part 702 is a lower portion of the cylindrical part 701 which is fitted in the large-diameter part 62 of the body 60. The protruding part 703 is an upper portion of the cylindrical part 701 and protrudes upward from the large-diameter part 62. The connecting flange 704 protrudes radially outward from a central portion of the protruding part 703 in the up-down direction. In the present modification, the connecting flange 704 is made of metal and integrally formed with the cylindrical part 701 to form the inner sleeve 700 as a single unit. However, the connecting flange 704 may be formed separately from the cylindrical part 701 and immovably connected to the cylindrical part 701. The connecting flange 704 includes an annular part 705 having a circular section and four screw fastening parts 706 protruding radially outward from the annular part 705. In the present modification, the screw fastening parts 706 are arranged at equal intervals in the circumferential direction around the hammering axis A1. A first threaded hole 707 is formed in each of the screw fastening parts 706 and extends through the screw fastening part 706 in the up-down direction. The first threaded hole 707 is configured such that a first screw 860, which will be described later, is threadably engaged therewith.

The structure of connecting the barrel 14 and the tool holder 605 is now described. In the present modification, the barrel 14 and the tool holder 605 are connected to each other via a connecting rubber 83, the above-described connecting flange 704 of the inner sleeve 700 and a retainer ring 84.

As shown in FIGS. 8, 11 and 12, the connecting rubber 83 has a cylindrical shape which is coaxial with the hammering axis A1. The connecting rubber 83 includes a small-diameter part 831 forming a lower portion of the connecting rubber 83 and a large-diameter part 832 forming an upper portion of the connecting rubber 83. The small-diameter part 831 has a through hole 830 which has a diameter substantially equal to the outer diameter of the protruding part 703 and which extends along the hammering axis A1. The large-diameter part 832 has a fitting recess 833 into which the connecting flange 704 (the annular part 705 and the screw fastening part 706) can be fitted. The fitting recess 833 is formed as a recess recessed downward from an upper end of the connecting rubber 83. An upper end of the through hole 830 is open to a central portion of a bottom of the fitting recess 833. The fitting recess 833 has protruding parts 834 which protrude radially outward respectively corresponding to the four screw fastening parts 706, and a through hole 835 corresponding to the first threaded hole 707 is formed in a central portion of a bottom of each of the protruding parts 834. Further, an outer circumferential portion of the large-diameter part 832 has a shape corresponding to the inner circumferential portion of the large-diameter part 142 of the barrel 14. More specifically, four recesses 836 recessed radially inward are formed at equal intervals in the circumferential direction in the outer circumferential portion of the large-diameter part 832 and shaped to be engaged with the four screw fastening parts 143 (see FIG. 9) of the large-diameter part 142. It is noted that the four protruding parts 834 and the four recesses 836 are alternately arranged in the circumferential direction.

As shown in FIGS. 11 and 12, the retainer ring 84 is formed as an annular metal plate-like member. The retainer ring 84 has substantially the same outer diameter as the large-diameter part 142 and the flange 64, and has an inner diameter substantially equal to the outer diameter of the small-diameter part 831 of the connecting rubber 83. The retainer ring 84 has four through holes 841 and four through holes 842 which are alternately arranged at equal intervals in the circumferential direction. Each of the through holes 841 is configured such that a shaft of the second screw 870 can be inserted therethrough. Each of the through holes 842 has a larger diameter than the through hole 841 and is configured such that a shaft of the first screw 860 can be loosely inserted therethrough. Further, an outer edge of a lower surface of the retainer ring 84 is formed as a stepped part 843 which is recessed upward.

The barrel 14 and the tool holder 605 are connected as follows via the connecting rubber 83, the connecting flange 704 and the retainer ring 84 which are configured as described above.

Figure 10:
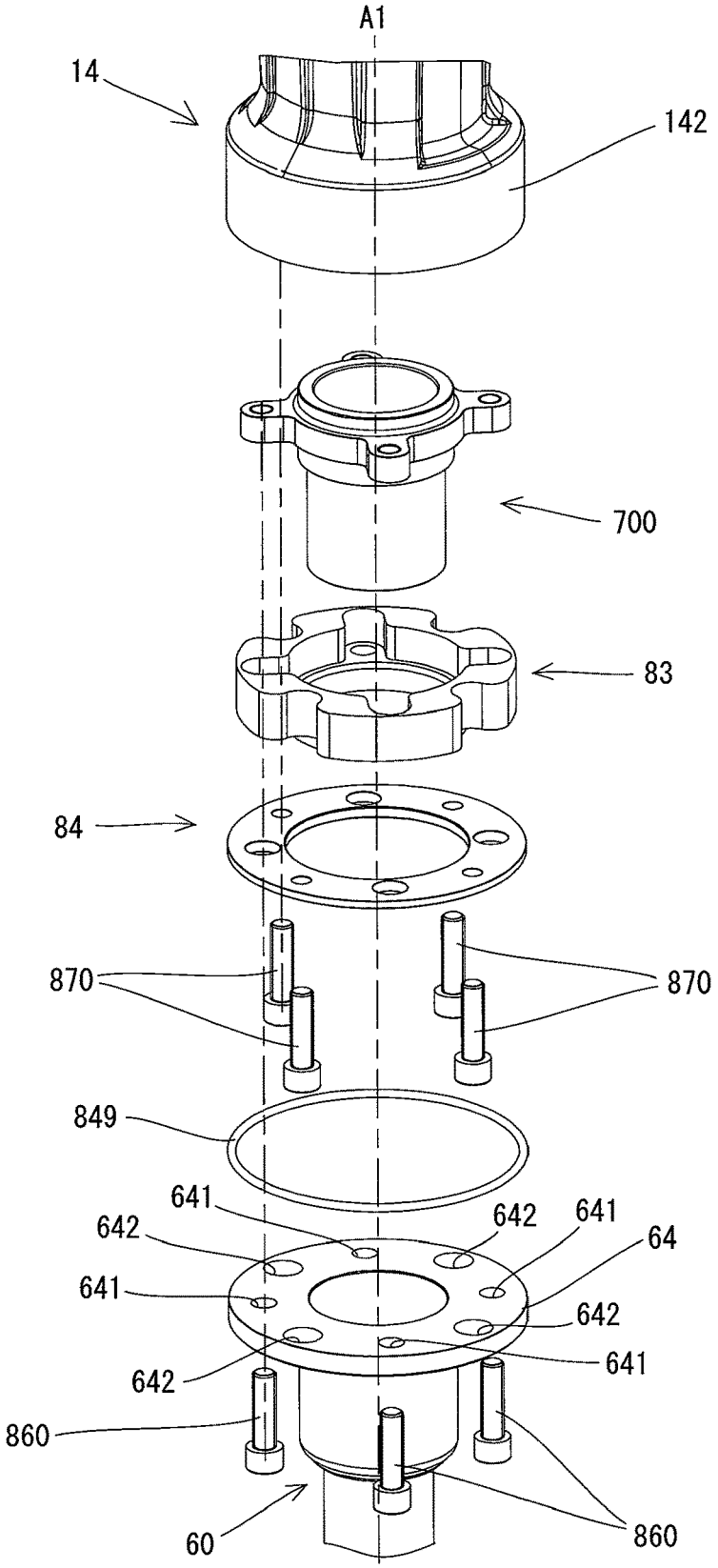
FIG. 10 is another exploded perspective view of the lower end portion of the electric hammer shown in FIG. 8.

As shown in FIGS. 8 to 10, an O-ring 849 which has substantially the same outer diameter as the flange 64 is disposed on a top surface of the flange 64 of the tool holder 605. The retainer ring 84 is disposed on the O-ring 849 such that the O-ring 849 is engaged with the stepped part 843. The small-diameter part 831 of the connecting rubber 83 is fitted into the retainer ring 84. Further, the inner sleeve 700 is fitted into the body 60 of the tool holder 605 and the connecting rubber 83. More specifically, the fitted part 702 of the inner sleeve 700 is disposed inside the body 60 (the large-diameter part 62) of the tool holder 605, and the protruding part 703 and the connecting flange 704 of the inner sleeve 700 are disposed inside the connecting rubber 83. In this process, the through hole 641 of the flange 64, the through hole 842 of the retainer ring 84, the through hole 835 of the connecting rubber 83 and the first threaded hole 707 of the inner sleeve 700 are coaxially aligned in this order from below, and the through hole 642 of the flange 64 and the through hole 841 of the retainer ring 84 are coaxially aligned in this order from below. In this manner, these four members are positioned relative to each other.

In the present modification, only the rubber ring 67 is disposed within the body 60 (the large-diameter part 62) of the tool holder 605, and a lower end of the inner sleeve 70 is held in direct contact with the rubber ring 67 without a washer. In order to provide a larger contact surface between the inner sleeve 700 and the rubber ring 67, however, like in the above-described embodiment, a washer may be disposed between the inner sleeve 700 and the rubber ring 67. Further, in place of the rubber ring 67, an elastic element formed of a different elastic material (such as urethane) may be employed.

After positioning as describe above, each of the four first screws 860 is inserted through the through hole 641, the through hole 842 and the through hole 835 in this order from below the flange 64 and threadably engaged with the first threaded hole 707 of the screw fastening part 706 of the connecting flange 704, so that the inner sleeve 700 is fixed to the body 60. It is noted that the length of the shaft of the first screw 860 is set such that a tip end of the shaft slightly protrudes from an upper surface of the screw fastening part 706. The shaft of the first screw 860 is loosely disposed in the through hole 842 of the retainer ring 84, and thus the retainer ring 84 is not fixed to the inner sleeve 700 or the body 60.

Subsequently, the four screw fastening parts 143 are positioned to be engaged with the four recesses 836 formed in the outer circumferential portion of the connecting rubber 83, and then the inner sleeve 700 is inserted into the lower end portion of the barrel 14. At this time, the through hole 642 of the flange 64, the through hole 841 of the retainer ring 84 and the second threaded hole 144 of the screw fastening part 143 of the barrel 14 are coaxially aligned in this order from below. Then, each of the four second screws 870 is inserted through the through hole 642 and the through hole 841 from below the flange 64 and threadably engaged with the second threaded hole 144 of the screw fastening part 143, so that the retainer ring 84 is fixed to the barrel 14 (the large-diameter part 142). In this state, the head of the second screw 870 is loosely disposed in the through hole 642 of the flange 64 and is not fixed to the tool holder 605. A clearance between the through hole 642 and the head of the second screw 870 is set such that the second screw 870 fixed to the barrel 64 and the tool holder 605 (the flange 64) are prevented from coming into contact with each other when the barrel 14 and the tool holder 605 move relative to each other in the radial direction.

When the barrel 14 and the tool holder 605 are connected as described above, as shown in FIG. 8, the connecting rubber 83 is disposed between the impact bolt 56 and the barrel 14 in the radial direction. More specifically, the connecting rubber 83 is disposed between the cylindrical part 701 of the inner sleeve 700 and the barrel 14. Thus, the cylindrical part 701 which forms a portion of the tool holder 605 and the barrel 14 are connected with each other in the radial direction via the connecting rubber 83 in a state in which the cylindrical part 701 and the tool holder 605 are not in contact with each other. Further, an outer circumferential surface (radially outer surface) of the connecting rubber 83 is covered by the barrel 14 (the large-diameter part 142).

Further, a portion of the connecting rubber 83 is disposed between the barrel 14 and the tool holder 605 (the body 60) in the hammering-axis A1 direction (up-down direction). The connecting flange 704 (the screw fastening part 706) fixed to the tool holder 605 and the retainer ring 84 fixed to the barrel 14 are arranged to partly overlap (be opposed to) each other in the hammering-axis A1 direction (up-down direction), and a portion of the connecting rubber 83 is interposed between these overlapped parts. A clearance is formed between the upper surface of the flange 64 and the lower surface of the retainer ring 84. Similarly, a clearance is also formed between the upper surface of the screw fastening part 706 (and a tip end of the shaft of the first screw 860) and an inner lower end surface 146 of the barrel 14 which is located above the screw fastening part 706. With such an arrangement, the tool holder 605 and the barrel 14 are connected with each other in the hammering-axis A1 direction via the connecting rubber 83 in a state in which the tool holder 605 and the barrel 14 are not in contact with each other.

When the barrel 14 and the tool holder 605 relatively move toward each other, an outer peripheral part 837 of an upper end of the connecting rubber 83 is compressed by the inner lower end surface 146 of the barrel 14. At this time, the O-ring 849 disposed between the retainer ring 84 and the flange 64 is also compressed, but the O-ring 849 prevents the retainer ring 84 and the flange 64 from coming into contact with each other. Further, even when the O-ring 849 is compressed to the maximum, the inner lower end surface 146 does not come into contact with the screw fastening part 706 (and the tip end of the shaft of the first screw 860). On the other hand, when the barrel 14 and the tool holder 605 relatively move away from each other, a portion of the connecting rubber 83 which is interposed between the connecting flange 704 (the screw fastening part 706) and the retainer ring 84 is compressed. Thus, the connecting rubber 83 is interposed between the barrel 14 and the tool holder 605 so as to be compressed when the barrel 14 and the tool holder 605 relatively move in either direction toward or away from each other.

In the hammer 102 according to the present modification, like in the hammer 1 of the above-described embodiment, transmission of vibration from the tool holder 605 to the barrel 14 both in the hammering-axis A1 direction and in the radial direction can be effectively suppressed and thus noise which might otherwise arise from the vibration of the barrel 14 can be reduced.

Further, in the present embodiment, the elastic element for elastically connecting the tool holder 605 and the barrel 14 in the hammering-axis A1 direction and the elastic element for elastically connecting the tool holder 605 and the barrel 14 in the radial direction are integrally formed as a single elastic member, that is, the connecting rubber 83. This structure can improve assembling efficiency and reduce the number of components. Further, also by providing the connecting flange 704 (the screw fastening parts 706), in place of the first members 81 of the above-described embodiment, which is integrally formed with the cylindrical part 701 of the inner sleeve 700, improvement of assembling efficiency and reduction of the number of components can be realized. Further, the retainer ring 84 provided in place of the second members 82 of the above-described embodiment is a single member, but can be opposed to the connecting flange 704 (the screw fastening parts 706) at plural positions in the circumferential direction. With such a structure, when the barrel 14 and the tool holder 605 relatively move away from each other, the connecting rubber 83 can be compressed at plural positions in the circumferential direction. Thus, according to the present modification, a simpler and more effective connecting structure is realized.

Further, in the present modification, the outer circumferential surface of the connecting rubber 83 is covered by the barrel 14, which can suppress deterioration of the connecting rubber 83 due to exposure to dust generated during the chipping operation. Further, in the present modification, not only the outer circumferential surface, but also other parts of the connecting rubber 83 are covered by the retainer ring 84 and the flange 64, so that deterioration of the connecting rubber 83 can be further effectively suppressed.

Correspondences between the features of the present modification and the features of the present invention are as follows. The hammer 102 is an example that corresponds to the "impact tool" according to the present invention. The tool holder 605 is an example that corresponds to the "tool-accessory holding part" according to the present invention. The barrel 14 is an example that corresponds to the "body" according to the present invention. The impact bolt 56 is an example that corresponds to the "first hammering member" according to the present invention. The connecting rubber 83 is an example that corresponds to each of the "first elastic element" and the "second elastic element" and the "single elastic member" according to the present invention. The connecting flange 704 and the retainer ring 84 are examples that correspond to the "first member" and the "second member", respectively, according to the present invention. The cylindrical part 701 of the inner sleeve 700 is an example that corresponds to the "slide-guide member" according to the present invention. Further, as a matter of course, like the connecting structure of the above-described embodiment, the connecting structure of the present modification can be appropriately changed.

In the above-described embodiment and modifications, the electric hammer 1, 101, 102 which is capable of performing only the hammering operation is described as an example of the impact tool, but the impact tool may be a hammer drill which is capable of performing a drilling operation of rotationally driving the tool accessory 9, in addition to the hammering operation. Further, in the above-described embodiment and modifications, the striker 51 is configured to linearly move the tool accessory 9 in the hammering-axis A1 direction by linearly moving and indirectly colliding with an axial one end (rear end) of the tool accessory 9 via the impact bolt 53, 530, 56. However, the striker 51 may be configured to move the tool accessory 9 by directly colliding with the end of the tool accessory 9. In this case, the striker 51 corresponds to the "first hammering member" according to the present invention. Further, the striker 51 does not need to be driven by the piston 37 which reciprocates within the cylinder 50, and may be driven by a bottomed cylindrical piston-cylinder which reciprocates in the hammering-axis A1 direction.

The arrangements and the structures of the motor 2 and the first motion converting mechanism 3 are not limited to those of the above-described embodiment. For example, a direct current motor may be employed in place of the motor 2. In place of the first motion converting mechanism 3, any structure may be employed which is capable of converting rotation of the motor into reciprocating motion of the piston 37 or a piston-cylinder. Further, the impact tool is not limited to that which is powered by the motor 2. For example, the impact tool may be powered by compressed air generated by an air compressor and provided with a driving mechanism configured to linearly move the striker 51 which is slidably arranged within the cylinder 50 in the hammering-axis A1 direction. The hammer 1, 101, 102 does not need to have the second motion converting mechanism 4 and may have a different vibration-proofing mechanism.

A portion of the impact tool to which the tool holder 6 for holding the tool accessory 9 is connected in the hammering-axis A1 direction via the elastic element does not need to have a circular cylindrical shape like the barrel 12, as long as the portion has an internal space which communicates with the through hole 65 of the tool holder 6. In an impact tool which is configured to linearly drive the tool accessory 9 in the hammering-axis A1 direction via the striker 51, however, the cylinder 50 or a piston-cylinder having a circular cylindrical shape is typically employed to linearly drive the striker 51. In such a case, it is quite common that a portion of the impact tool which houses the cylinder 50 or the piston-cylinder has a cylindrical (tubular) shape (not limited to a circular cylindrical shape) having a relatively large internal space (in which no parts are disposed) compared with other portions. Further, a clearance is often provided particularly between the portion which houses the cylinder 50 or the piston-cylinder and the cylinder 50 or the piston cylinder. In such a case, noise may further increase. In view of this, the following features are provided. One or more of the features can be employed in combination with any one of the hammer drills 1, 101, 102 of the embodiment and the modifications, or in combination with any one of the claimed inventions.

Aspect 1

The body may include a cylindrical-member housing part having a cylindrical shape and housing a circular cylindrical member disposed coaxially with the hammering axis, and the cylindrical-member housing part and the tool-accessory holding part of the body may be connected in the hammering-axis direction via the first elastic element so as to be movable relative to each other.

Aspect 2

In aspect 1 above, a clearance nay be provided between the cylindrical-member housing part and the circular cylindrical member.

Aspect 3

In aspect 1 or 2 above, the circular cylindrical member may have an air chamber of which air pressure fluctuations are utilized to drive the first hammering member.

Aspect 4

In any one of aspects 1 to 3 above, the body may include a driving-mechanism housing part which houses a driving mechanism configured to linearly move the first hammering member.

Aspect 5

In any one of aspects 1 to 4 above, an elastic element may be interposed between the tool-accessory holding part and the circular cylindrical member.

Aspect 6

The single elastic member may be cylindrically shaped, at least a portion of the single elastic member may be disposed between the slide-guide member and the body in the radial direction, and at least a portion of the single elastic member may be disposed between the first member and the second member in the hammering-axis direction.

Aspect 7

The first member may be configured to protrude radially outward from the slide-guide member, and the second member may be disposed to be at least partly opposed to the first member in the hammering-axis direction.

Further, in an impact tool which is configured to linearly drive a tool accessory by causing a first hammering member to collide with the tool accessory, it is preferable to suppress transmission of vibration from the second hammering member or the first hammering member, like the above-described striker 51 and impact bolt 530, to the body. In view of this, the following features are provided.

Aspect 8

An impact tool configured to linearly drive a tool accessory in a prescribed hammering-axis direction, the impact tool comprising:

a tool-accessory holding part configured to hold the tool accessory so as to be movable in the hammering-axis direction;

a body connected to the tool-accessory holding part;

a first hammering member disposed to be linearly movable in the hammering-axis direction and configured to drive the tool accessory in the hammering-axis direction by colliding with the tool accessory;

a circular cylindrical member disposed coaxially with a hammering axis within the body; and a second hammering member disposed to be movable in the hammering-axis direction within the circular cylindrical member and configured to linearly move the first hammering member by colliding with the first hammering member, wherein:

the second hammering member has a circular column part having a circular column shape and has one or more elastic elements disposed on an outer circumferential surface of the circular column part, and the one or more elastic elements are configured to be slidable in the hammering-axis direction along an inner circumferential surface of the circular cylindrical member and configured to hold the second hammering member within the circular cylindrical member in a state in which the outer circumferential surface is not in contact with the inner circumferential surface.

Aspect 9

An impact tool configured to linearly drive a tool accessory in a prescribed hammering-axis direction, the impact tool comprising:

a tool-accessory holding part configured to hold the tool accessory so as to be movable in the hammering-axis direction;

a body connected to the tool-accessory holding part;

a first hammering member disposed be linearly movable in the hammering-axis direction and configured to drive the tool accessory in the hammering-axis direction by colliding with the tool accessory;

a circular cylindrical member disposed coaxially with a hammering axis within the body; and a second hammering member disposed to be movable in the hammering-axis direction within the circular cylindrical member and configured to linearly move the first hammering member by colliding with the first hammering member, wherein:

the first hammering member has a circular column part having a circular column shape and has one or more elastic elements disposed on an outer circumferential surface of the circular column part, and the one or more elastic elements are configured to be slidable in the hammering-axis direction along an inner circumferential surface of the tool-accessory holding part and to hold the first hammering member within the tool-accessory holding part in a state in which the outer circumferential surface is not in contact with the inner circumferential surface.

DESCRIPTION OF NUMERALS

1: electric hammer, 2: motor, 21: output shaft, 3: first motion converting mechanism, 31: speed reducing mechanism, 33: first shaft, 34: eccentric pin, 36: first rod, 37: piston, 4: second motion converting mechanism, 43: second shaft, 46: second rod, 47: counterweight, 5: striking mechanism, 50: cylinder, 51: striker, 512; O-ring, 53, 530, 56; impact bolt, 531: upper end part, 532: lower end part, 533, 535: central part, 537: O-ring, 538; slide ring, 541: rubber ring, 542: washer, 543: washer, 55: air chamber, 6, 600, 605: tool holder, 60: body, 61: small-diameter part, 62: large-diameter part, 63: stepped part, 64: flange, 641: through hole, 642: through hole, 65: through hole, 651: tool insertion hole, 67: rubber ring, 68: washer, 7, 70, 700: inner sleeve, 701: cylindrical part, 702: fitted part 73, 703: protruding part, 704: connecting flange, 705: annular part, 706: screw fastening part, 707: first threaded hole, 75: O-ring, 8: connection part, 80, 83: connecting rubber, 800: through hole, 801: first member receiving part, 802: first recess, 803: first fitting hole, 806: second member receiving part, 807: second recess, 808: second fitting hole, 81: first member, 811: first compression part, 813: first connection part, 815: first threaded hole, 82: second member, 822: second compression part, 823: second connection part, 825: through hole, 830: through hole, 831: small-diameter part, 832: large-diameter part, 833: fitting recess, 834: protruding part, 835: through hole, 836: recess, 837: outer edge, 84: retainer ring, 841: through hole, 842: through hole, 843: stepped part, 849: O-ring, 86, 860: first screw, 87, 870: second screw, 9: tool accessory, 10: body, 11: body housing, 12, 120, 14: barrel, 121, 141: body, 122, 142: large-diameter part, 125, 144: second threaded hole, 143: screw fastening part, 146: inner lower end surface, 13: outer sleeve, 131: cylindrical part, 132: flange, 133: upper cylindrical part, 134: lower cylindrical part, 15: outer housing, 16: handle, 161: electric switch, 162: trigger, 19: power cable, 20: controller

The invention claimed is:

1. An impact tool configured to linearly drive a tool accessory in a hammering-axis direction, the impact tool comprising:

a tool-accessory holding part having a through hole extending in the hammering-axis direction and configured to hold the tool accessory inserted into the through hole so as to be movable in the hammering-axis direction;

a body connected to the tool-accessory holding part in the hammering-axis direction and having an internal space communicating with the through hole; and a first hammering member disposed to be linearly movable in the hammering-axis direction and configured to drive the tool accessory in the hammering-axis direction by colliding with the tool accessory, wherein:

the tool-accessory holding part and the body are connected in the hammering-axis direction via a first elastic element so as to be movable relative to each other;

the first elastic element is a single elastic member located between the tool-accessory holding part and the body and configured such that the first elastic element is compressed when the tool-accessory holding part and the body move toward and away from each other; and a second elastic element is interposed between the first hammering member and the body in a radial direction with respect to the hammering-axis direction.

2. The impact tool as defined in claim 1, wherein:

a portion of the tool-accessory holding part is disposed between the first hammering member and the body in the radial direction, and the second elastic element is disposed between the portion of the tool-accessory holding part and the body.

3. The impact tool as defined in claim 1, further comprising:

a first member fixed to the tool-accessory holding part and disposed between the tool-accessory holding part and the body in the hammering-axis direction; and a second member fixed to the body and disposed between the tool-accessory holding part and the first member in the hammering-axis direction, wherein:

at least a portion of the first elastic element is interposed between the first member and the second member.

4. The impact tool as defined in claim 3, wherein:

the tool-accessory holding part includes a cylindrical slide-guide member, the slide-guide member being configured to slidably guide the first hammering member in the hammering-axis direction, and the first member is integrally formed with the slide-guide member.

5. The impact tool as defined in claim 3, wherein:

the tool-accessory holding part includes a cylindrical guide member configured to guide the first hammering member when the first hammering member moves in the hammering-axis direction;

the first elastic member and second elastic member are integral as a single elastic member having a cylindrical shape; and the single elastic member has a first portion located between the cylindrical guide member and the body in a radial direction of the cylindrical guide member and a second portion located between the first member and the second member in the hammering-axis direction.

6. The impact tool as defined in claim 5, wherein:

the first member extends radially outward from the cylindrical guide member; and the second member overlaps the first member in the hammering-axis direction.

7. The impact tool as defined in claim 1, further comprising:

a plurality of first members fixed to the tool-accessory holding part and disposed between the tool-accessory holding part and the body in the hammering-axis direction; and a plurality of second members fixed to the body and disposed between the tool-accessory holding part and the plurality of first members in the hammering-axis direction, wherein:

the plurality of first members and the plurality of second members are alternately arranged in a circumferential direction around the hammering-axis, and at least a portion of the first elastic element is interposed between the plurality of first members and the plurality of second members.

8. The impact tool as defined in claim 1, wherein the first elastic element and the second elastic element are integrally formed as a single elastic member.

9. The impact tool as defined in claim 1, wherein the first elastic element comprises rubber and an outer circumferential surface of the first elastic element is covered.

10. An impact tool configured to linearly drive a tool accessory in a hammering-axis direction, the impact tool comprising:

a tool-accessory holding part having a through hole extending in the hammering-axis direction and configured to hold the tool accessory inserted into the through hole so as to be movable in the hammering-axis direction;

a body connected to the tool-accessory holding part in the hammering-axis direction and having an internal space communicating with the through hole;

a first hammering member disposed to be linearly movable in the hammering-axis direction and configured to drive the tool accessory in the hammering-axis direction by colliding with the tool accessory;

a circular cylindrical member disposed coaxially with the hammering-axis in the internal space; and a second hammering member disposed to be movable in the hammering-axis direction within the circular cylindrical member and configured to linearly move the first hammering member by colliding with the first hammering member, wherein:

the tool-accessory holding part and the body are connected in the hammering-axis direction via a first elastic element so as to be movable relative to each other;

a second elastic element is interposed between the first hammering member and the body in a radial direction with respect to the hammering-axis direction;

the second hammering member has a circular column part having a circular column shape and has one or more third elastic elements disposed on an outer circumferential surface of the circular column part; and the one or more third elastic elements are slidable in the hammering-axis direction along an inner circumferential surface of the circular cylindrical member and configured to hold the second hammering member within the circular cylindrical member in a state in which the outer circumferential surface is not in contact with the inner circumferential surface.

11. The impact tool as defined in claim 10, wherein:

the second hammering member is configured to be moved in the hammering-axis direction within the circular cylindrical member by pressure fluctuations of air in an air chamber formed in the circular cylindrical member, and at least one of the one or more third elastic elements has an annular shape to surround a whole circumference of the outer circumferential surface and also serves as a sealing member for the air chamber.

* * * * *